US008998752B2

(12) United States Patent
Parvanov

(10) Patent No.: US 8,998,752 B2
(45) Date of Patent: Apr. 7, 2015

(54) SOCCER SKILLS AND TECHNIQUES TRAINING MAT SET

(71) Applicant: Dragomir Penkov Parvanov, Plano, TX (US)

(72) Inventor: Dragomir Penkov Parvanov, Plano, TX (US)

( * ) Notice: Subject to any disclaimer, the term of this patent is extended or adjusted under 35 U.S.C. 154(b) by 0 days.

(21) Appl. No.: 13/858,919

(22) Filed: Apr. 8, 2013

(65) Prior Publication Data

US 2014/0274484 A1 Sep. 18, 2014

Related U.S. Application Data

(60) Provisional application No. 61/621,595, filed on Apr. 9, 2012.

(51) Int. Cl.
*A63B 69/00* (2006.01)
*A63B 71/06* (2006.01)

(52) U.S. Cl.
CPC ..... *A63B 69/002* (2013.01); *A63B 2243/0025* (2013.01); *A63B 2208/12* (2013.01); *A63B 2071/0694* (2013.01); *A63B 69/00* (2013.01)

(58) Field of Classification Search
CPC ..... A63B 69/00; A63B 69/002; A63B 2071/0694; A63B 2208/12; A63B 2243/0025
USPC ..... 473/446, 422, 438; 434/251, 247
See application file for complete search history.

(56) References Cited

U.S. PATENT DOCUMENTS

| | | | | | |
|---|---|---|---|---|---|
| 5,099,530 | A * | 3/1992 | Scott | 5/420 |
| 5,290,043 | A * | 3/1994 | Vidinic | 473/446 |
| 5,669,833 | A * | 9/1997 | Stone | 473/422 |
| 5,697,791 | A * | 12/1997 | Nashner et al. | 434/247 |
| 5,947,845 | A * | 9/1999 | Canelas | 473/446 |
| 7,033,289 | B2 * | 4/2006 | Sharrocks | 473/446 |
| 7,172,521 | B1 * | 2/2007 | Novis | 473/446 |
| D568,956 | S * | 5/2008 | Wilson | D21/780 |
| 8,226,504 | B1 * | 7/2012 | Lozado | 473/452 |
| 8,506,370 | B2 * | 8/2013 | Homsi | 463/2 |
| 2002/0098947 | A1 * | 7/2002 | Brown | 482/23 |
| 2003/0228942 | A1 * | 12/2003 | Hsieh | 473/446 |
| 2006/0211522 | A1 * | 9/2006 | Hapanowicz | 473/452 |
| 2007/0173356 | A1 * | 7/2007 | Hapanowicz | 473/451 |
| 2007/0219024 | A1 * | 9/2007 | Allegre | 473/422 |
| 2012/0178553 | A1 * | 7/2012 | Laird | 473/446 |
| 2014/0051531 | A1 * | 2/2014 | Mazzocchi | 473/451 |
| 2014/0274484 | A1 * | 9/2014 | Parvanov | 473/446 |

FOREIGN PATENT DOCUMENTS

WO WO 2010139025 A1 * 12/2010 ..... A63B 26/00

* cited by examiner

*Primary Examiner* — Mitra Aryanpour

(57) ABSTRACT

A training device for teaching and practicing simple and advanced soccer skills and techniques. The device includes a set of mats with printed indicators or indicia on the upper side or surface of each mat, the printed indicators are left and right foot indicia which are either printed in solid lines, or dashed lines, a printed circle indicating the soccer ball placement, solid and dashed lines with arrows for indicating the direction of travel, numbers for designating the sequence and order for the foot indicia, and instructional text for carrying out the designated soccer technique. Each training mat demonstrate a different soccer technique. The soccer student follows the instructions printed on the mat surface by placing their feet on the foot indicia and follow the sequence of steps shown on the mat.

1 Claim, 32 Drawing Sheets

SOCCER SKILLS AND TECHNIQUES TRAINING MAT SET

FIELD OF INVENTION

The present invention relates to a set of mats to teach and train soccer students basic and advanced soccer skills, techniques, turns, fakes and moves. The Soccer Skills and Techniques Training Mats of the present invention are specifically designed to provide a step-by-step guide for teaching the students the fundamentals of the specific soccer techniques.

The instructional indicia or indicators on the upper side or surface of the training mats represent the left and right foot indicia which is printed in solid lines, dashed line, indicia of a circle indicating the placement of the soccer ball, solid and dashed lines with arrows, indicating the direction of travel, numbers indicating the sequence and the particular order of steps which should be taken, and instructional text. The indicators or indicia on the upper side of the mat can be in different colors for ease of use, for example: —left foot indicia can be colored in blue, right foot indicia can be colored in red, the circle indicia can be colored in yellow, and the numbers, lines and arrows can be colored in white, alternatively, all of the instructional indicia or indicators can be formed in the same color.

The set of Soccer Skills and Technique Training Mats teach the exact positioning of the left and right feet in relation to each other and the soccer ball and the exact direction and sequence for carrying out each specific soccer skill, technique, turn, fake or move. The set of soccer mats demonstrate to the soccer student the proper foot placement mat set with prints of soccer student feet and soccer ball and the method of placing player's feet on specifically shown by the footprints places on top of the mat in specific sequence of the steps and movements to perform a specific soccer technique, skill, turn, fake or move is believed entirely new.

BACKGROUND OF THE INVENTION

The present application relates to soccer training, and more specifically to teaching soccer skills, techniques, turns, fakes, tricks and training exercises using a set of mats with printed upper surfaces that provide a step-by-step guide for the soccer student by indicating the exact position, direction and sequence of steps and movements for the soccer student's feet to take and the manner in which a soccer ball should be handled when carrying out a particular technique.

The applicant is a former professional soccer player and a current soccer coach that coaches youth soccer to students of all ages. From own personal coaching experience, applicant recognizes that teaching proper soccer techniques can be a lengthy and challenging process, given the complexity and nuances of some of the various soccer techniques and taking into consideration that the traditional way of coaching, which is by showing the technique to the students in a group setting can be extremely challenging.

Young soccer players commonly learn soccer techniques by observing the coach and then trying to duplicate the technique or movement while controlling the ball. Learning the techniques can be a challenging process for the young soccer students because of the complexity of the technique, since the technique may include multiple steps and moves in a specific sequence. The traditional manner of presenting soccer techniques to the students is another challenging task for the soccer coach, especially since the soccer coach is usually facing the students or facing the side which puts the movement in the reverse direction for students. The ability to learn varies from student to student, and in a group practice setting proves to be very challenging since some of the students fall behind and other students are way ahead of the rest of the students.

Through personal experience, the applicant has found that it is much easier for the soccer students to learn and carry out the steps is when each technique is broken down and displayed on a mat. The ability to demonstrate to the students the exact placement of the right and left feet on the mat and in relation to the soccer ball is very important in order to perform the correct technique.

The set of Soccer Skills and Technique Training Mats shows the students where to position each foot and the sequence and direction of each move or step as well as the part of the foot used to control the soccer ball. Each mat represents a different technique, and provides a step-by-step guide for the user to carry out a particular soccer drill.

The set of Soccer Skills and Technique Training Mats also, gives each soccer student the opportunity to learn the techniques at their own pace, as since each student's ability to learn is dependent on many factors such as the student's age and motor skills.

SUMMARY OF THE INVENTION

The present invention pertains to a teaching device and provides a step by step guide for learning and perfecting soccer techniques, turns, fakes and moves by soccer students of all ages.

It allows the soccer student to learn and perfect the soccer techniques on their own time and at their own pace.

It allows the soccer students to learn and perfect soccer techniques using both left and right feet to control the ball which is very important training in soccer.

The device includes a set of mats-Soccer Skills and Techniques Training Mat Set with printed instructional indicia on the upper surface of the mat that guide the soccer student step-by-step when learning the technique shown on the particular mat.

A mat for teaching and practicing simple and advanced soccer skills, techniques, turns, fakes and moves to soccer students of all ages.

The upper surface of the Soccer Skills and Technique Training Mat Set includes indicators which provide step-by-step guide for the soccer student when learning or practicing a specific soccer technique indicated on the particular training mat.

The indicators on the upper side of the training mat are specifically of footstep indicators printed in solid line, footstep indicators printed in dashed line, circle indicating where the soccer ball is placed, solid and dashed lines with arrows, step numbers, instructional text.

A foot indicator printed in solid line shows exactly where the soccer student places their corresponding foot on the surface on the mat. A footstep indicator printed in dashed fine shows exactly where the soccer students' foot is in the air above the training mat.

The soccer students steps on top of the training mat and follows the instructions printed on the mat surface by placing their feet on top of the footstep prints in exact position and sequence shown on the mat and controlling the soccer ball placed on top of the mat at the designated place with the part of the foot shown by footstep indicators printed in dashed line. Each training mat in the Soccer Skills and Techniques Training Mat Set shows and teaches different soccer technique and also teaches each technique to be performed with controlling left and right foot.

OPERATION

In operation a soccer student or athlete uses the Soccer Skills and Technique

Training Mat Set by placing their right and left feet on top of the left and right foot printed on the upper surface of the mat and following the direction and sequence of movements indicated on the mat surface.

The student starts by placing both feet on top of the corresponding right and foot indicia at the starting position, a soccer ball is positioned on top of the printed circle, the student proceeds by following the direction of the indicator lines and arrows and places his/her feet on top of the left and right foot indicia indicated at the end of each arrow, steps are performed in the sequence indicated by the step numbering placed next to each arrow. The user finishes the technique by controlling the soccer ball placed on top of the mat with the dashed line footprint which indicates the student's foot is in the air over the mat when controlling the soccer ball.

DETAILED DESCRIPTION OF THE FIGURES

In this description like reference numbers will be used to identify like elements according to the different figures that illustrate the preferred embodiment of the present invention.

Figure 1:
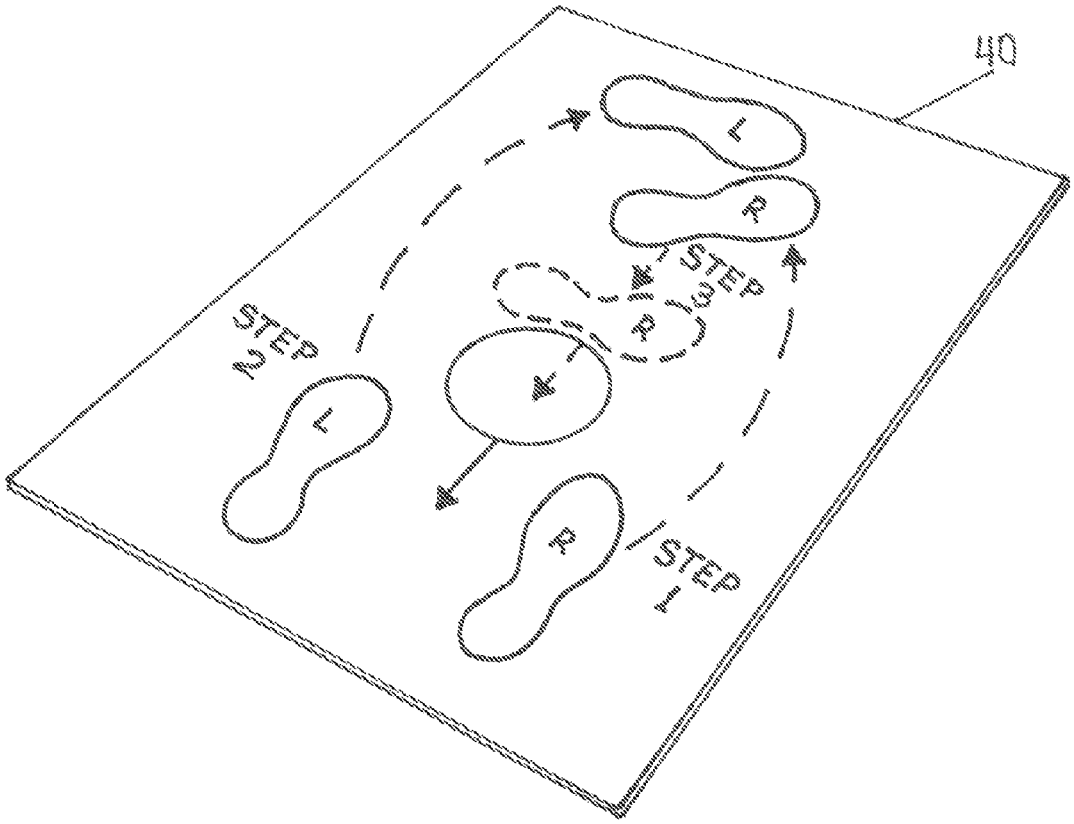
FIG. 1 is a top side view of the present invention

In FIG. 1 the present invention 40 is seen. The invention consists of a mat 40 with printed images of left and right feet, a circle, solid and dashed lines and solid and dashed arrows and step numbering.

Figure 2:
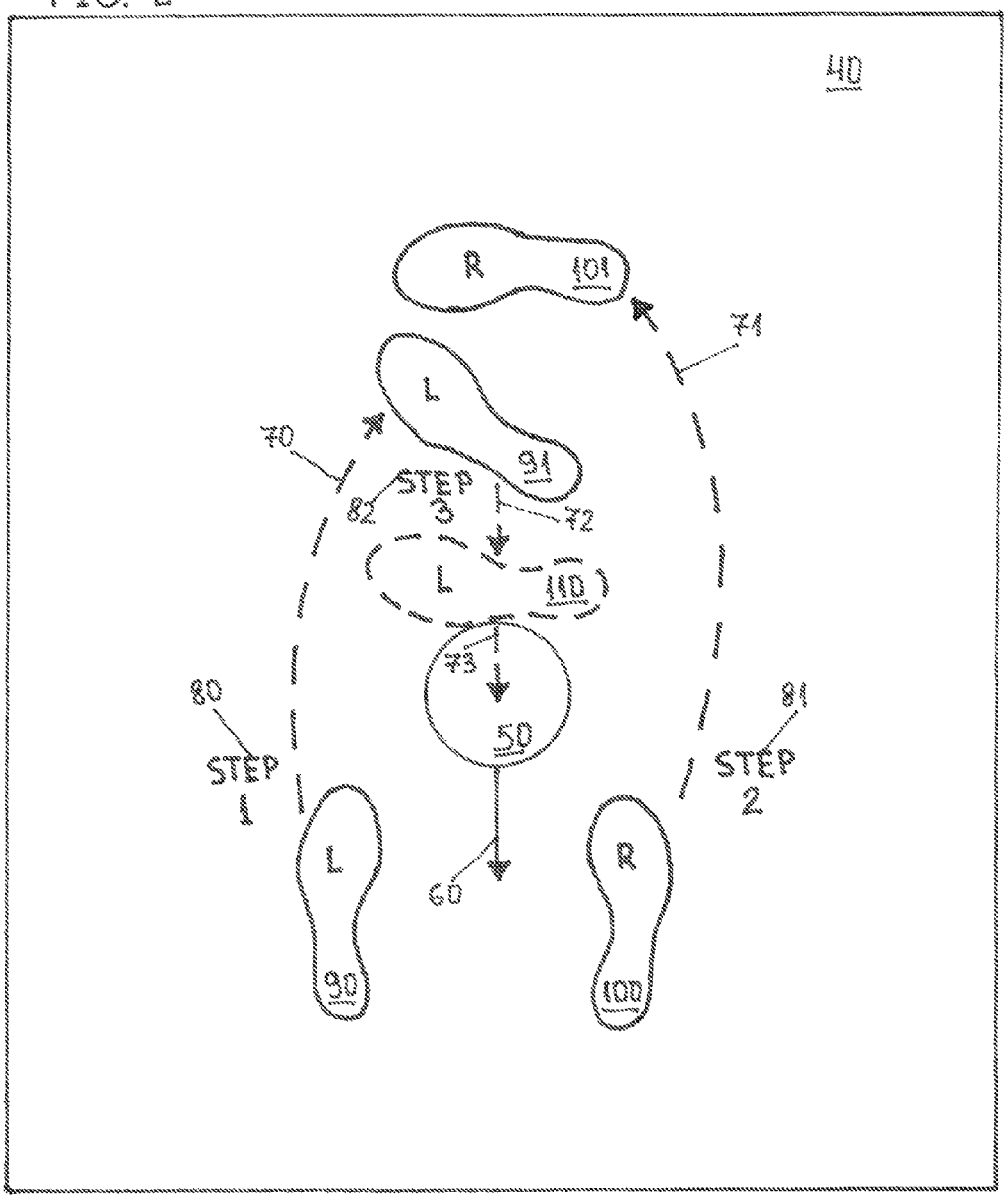
FIG. 2 through FIG. 31 represent top perspective views of the present invention showing the printed details of each mat that comprises the Soccer Skills and Techniques Training Mat Set.

FIG. 2 shows in detail the printed patterns on the upper side of the training mat and more specifically a circle 50 representing the soccer ball and the location where the actual soccer ball should be placed on top of the mat. A straight solid line and arrow 60 represents and shows the path and direction of the soccer ball. Multiple dashed lines and arrows 70, 71, 72 and 73 represent and show the exact movement and direction of the soccer student's feet. Markings "Step 1"-80, "Step 2"-81 and "STEP 3"-82 represent and show the sequence of steps and movements for the soccer student to follow in specific order. Left foot indicators printed in solid line 90 and 91 on the surface of the mat represent and show the exact location and position for the soccer student's left foot. Right foot indicators printed in solid line 100 and 101 that represent and show the exact location and position for the soccer student's right foot. A left foot indicator printed in dashed line 110 represent and show the exact position of the soccer students' left foot when in the air and not touching the surface of the mat and coming in contact with the soccer ball with using a specified portion of the soccer student's foot. FIG. 2 represents soccer technique "Step over-half turn", the soccer student's left foot to control the ball.

Figure 3:
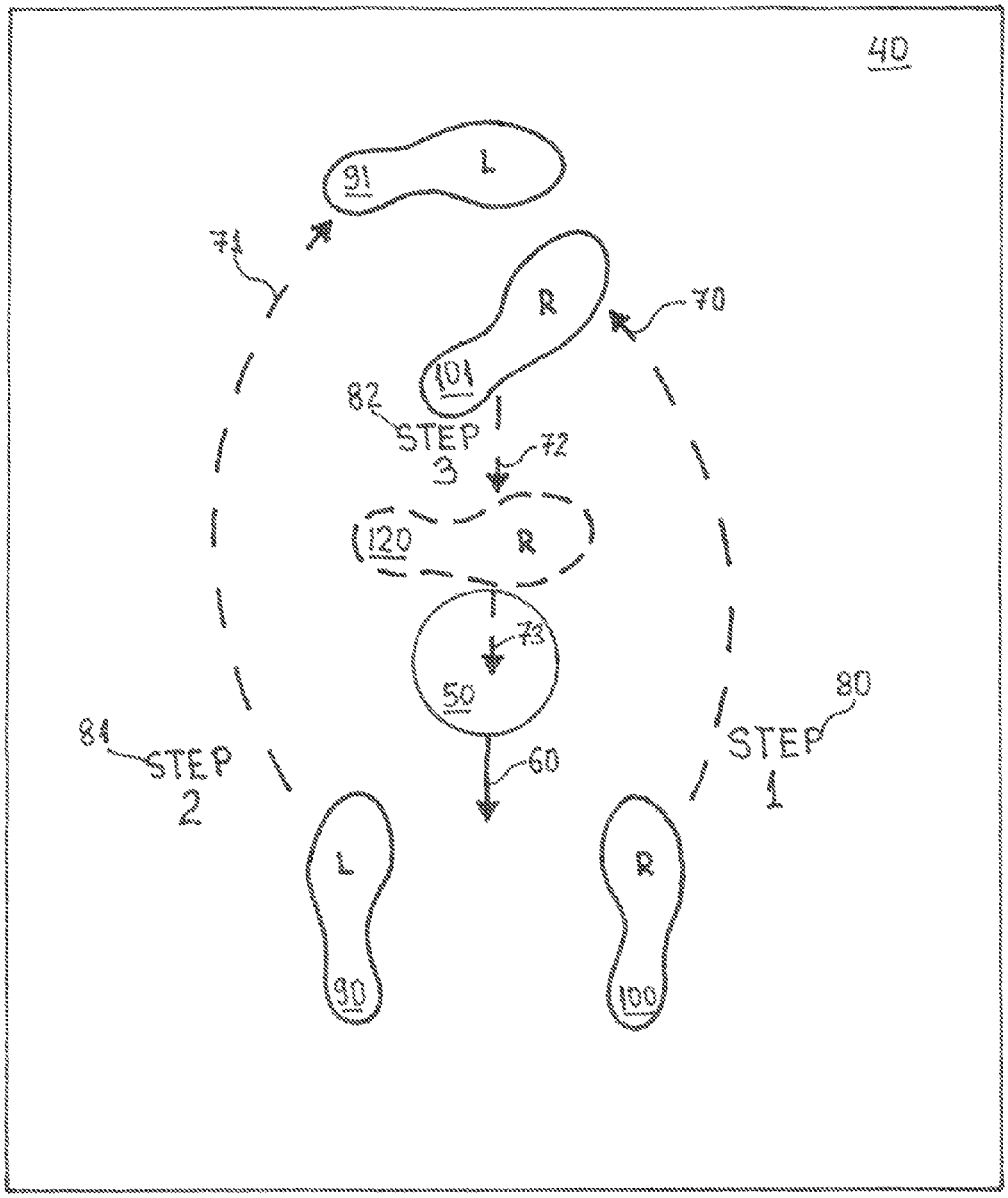

FIG. 3 demonstrates the soccer technique "Step over-half turn" using the right foot to control the soccer ball shown by right footstep indicator printed in dashed line 120.

Figure 4:
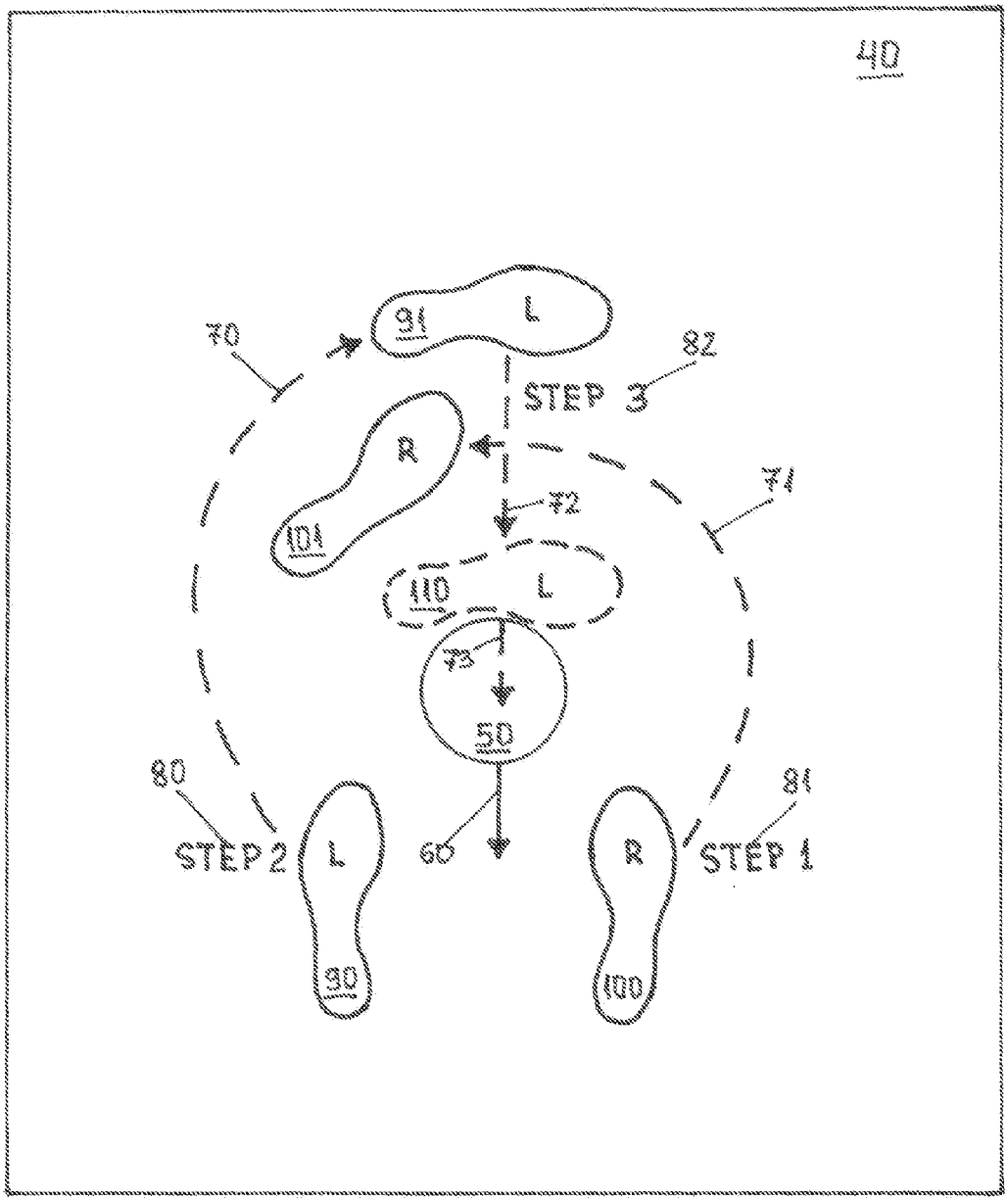

FIG. 4 demonstrates the soccer technique "Step over-full turn" using the left foot to control the soccer ball shown by left footstep indicator printed in dashed line 110.

Figure 5:
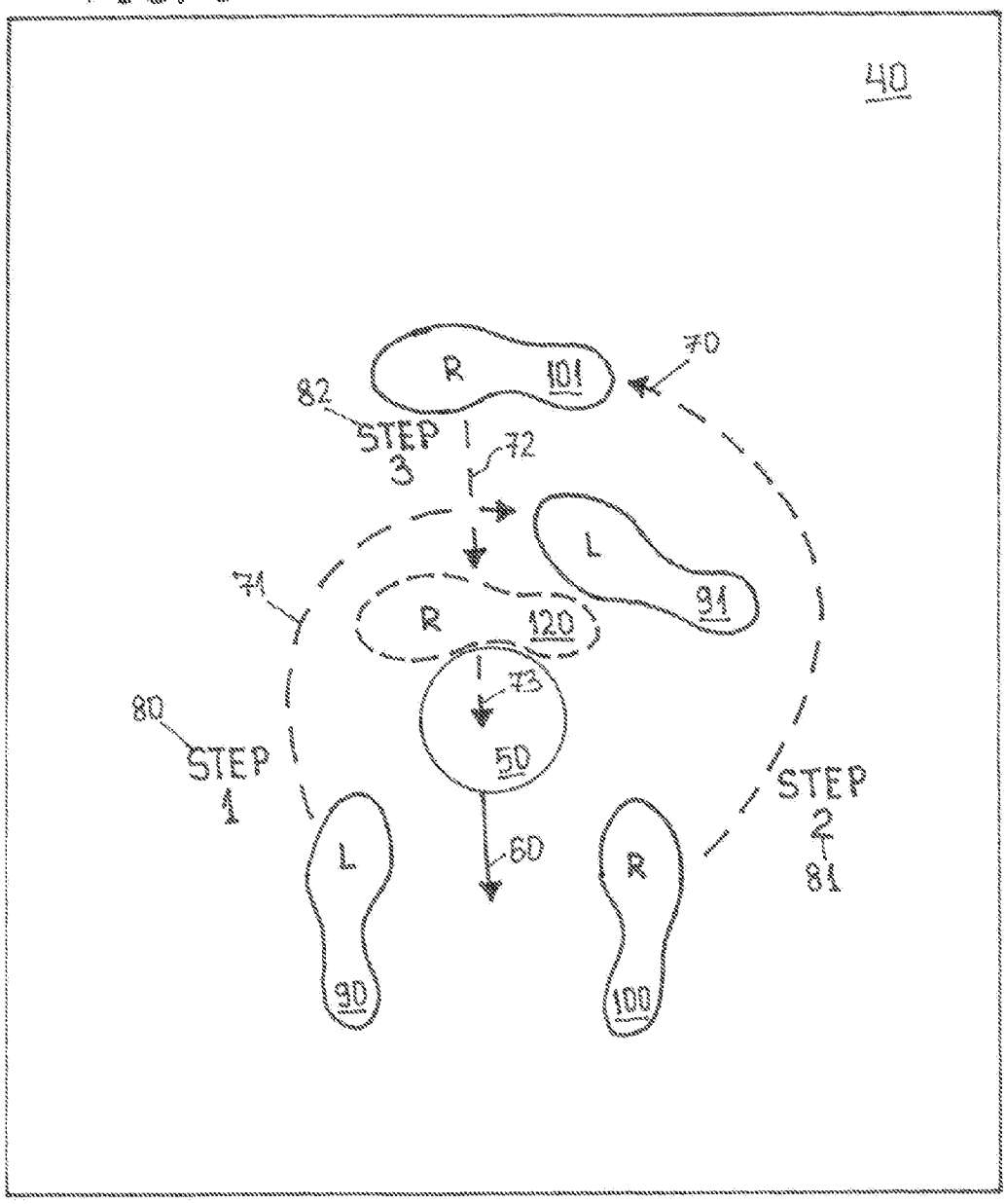

FIG. 5 demonstrates the soccer technique "Step over-full turn" using the right foot to control the soccer ball shown by right footstep indicator printed in dashed line 120.

Figure 6:
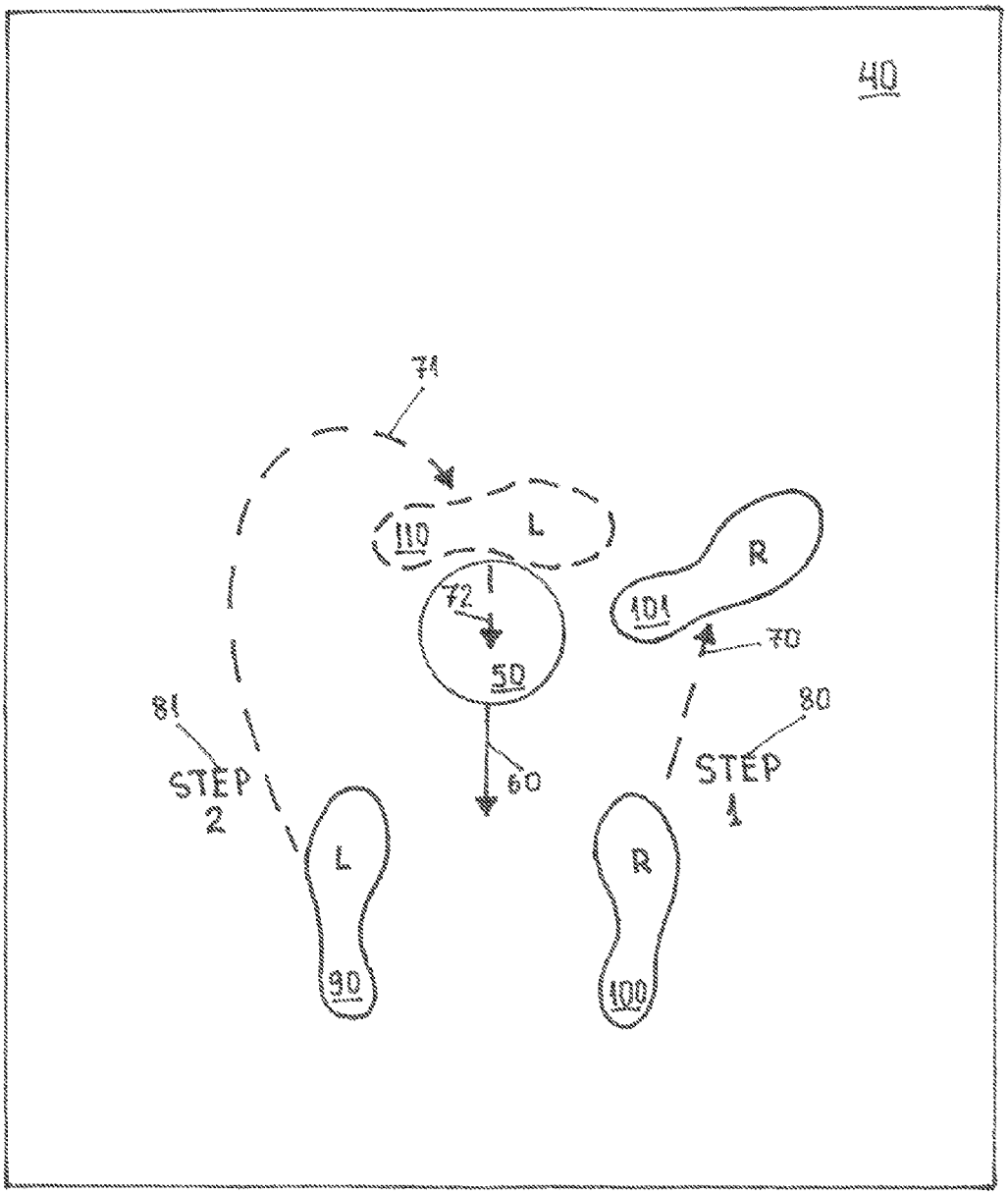

FIG. 6 demonstrates the soccer technique "Pull back turn" using the- left foot to control the soccer ball shown by left footstep indicator printed in dashed line 110.

Figure 7:
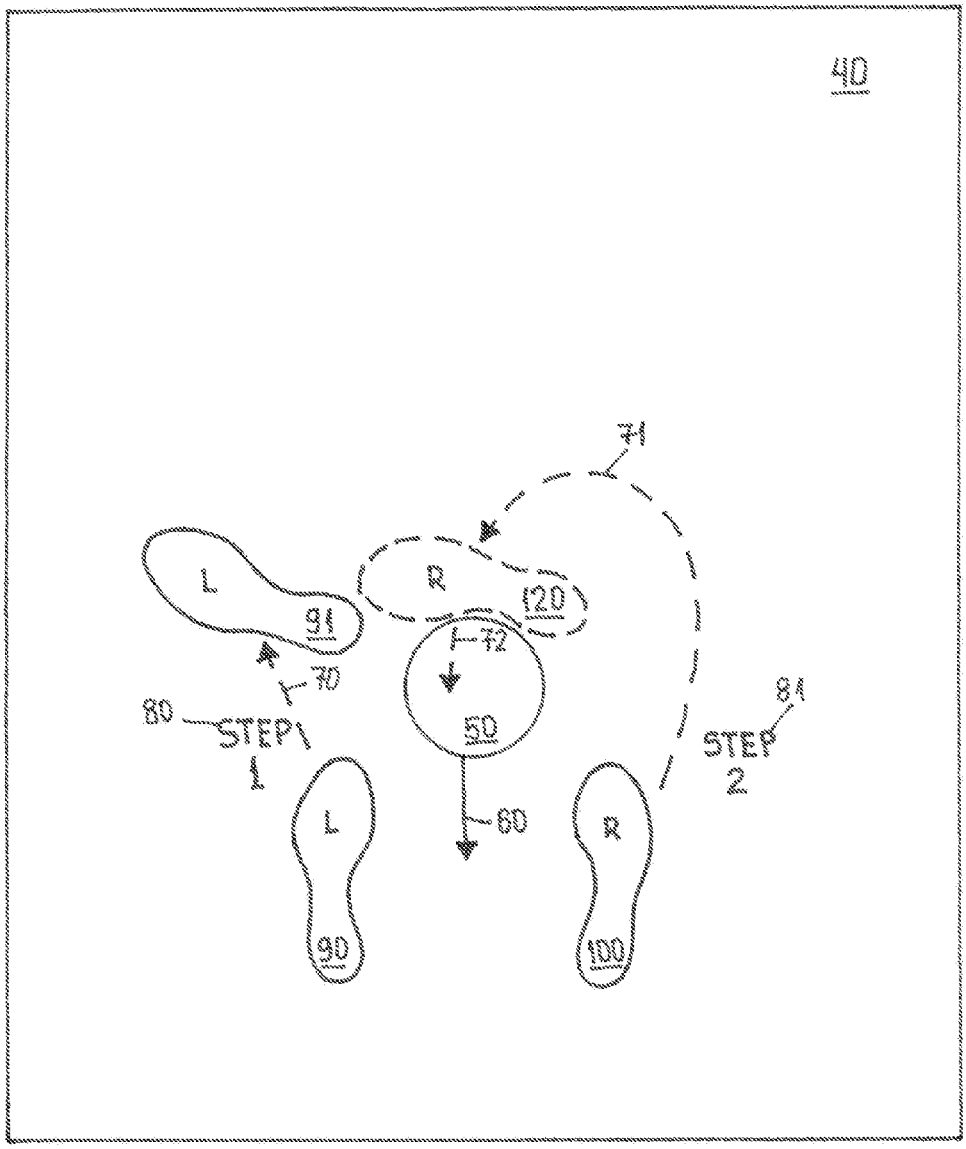

FIG. 7 demonstrates the soccer technique "Pull back turn" using the right foot to control the soccer ball shown by right footstep indicator printed in dashed line 120.

Figure 8:
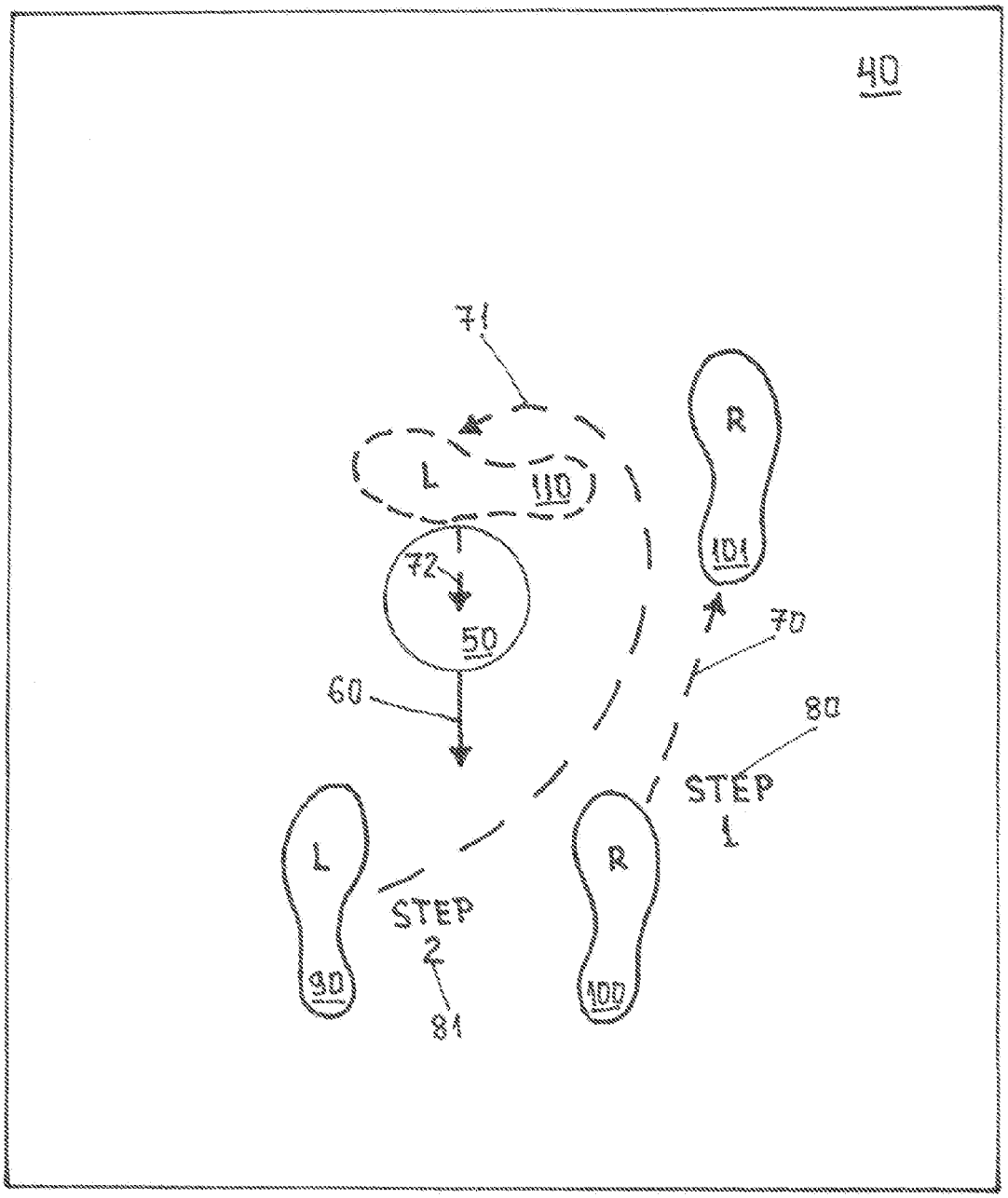

FIG. 8 demonstrates the soccer technique "Outside of foot cut back turn" using the left foot to control the soccer bail shown by left footstep indicator printed in dashed line 110.

Figure 9:
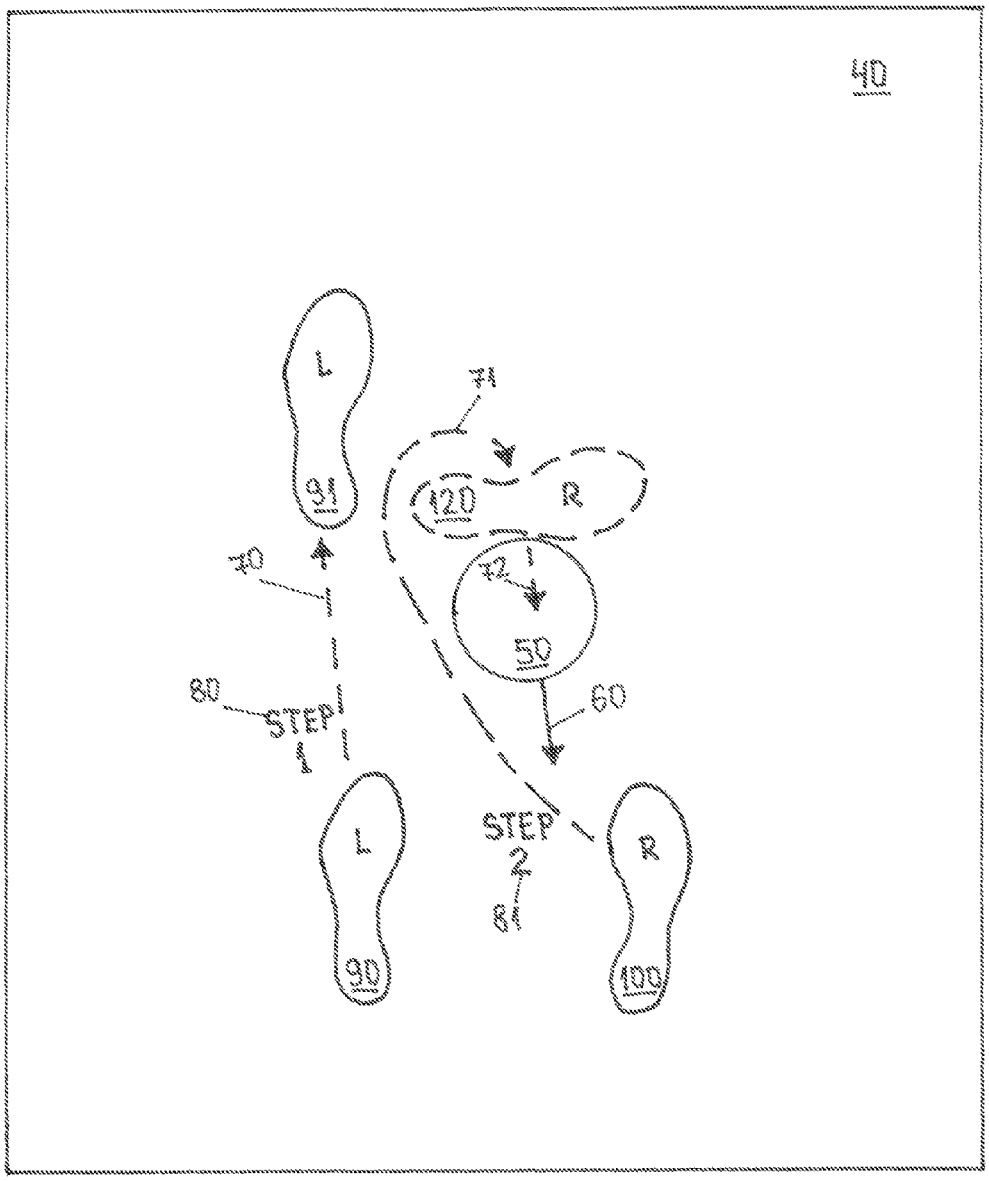

FIG. 9 demonstrates the soccer technique "Outside of foot cut back turn" using the right foot to control the soccer ball shown by right footstep indicator printed in dashed line 120.

Figure 10:
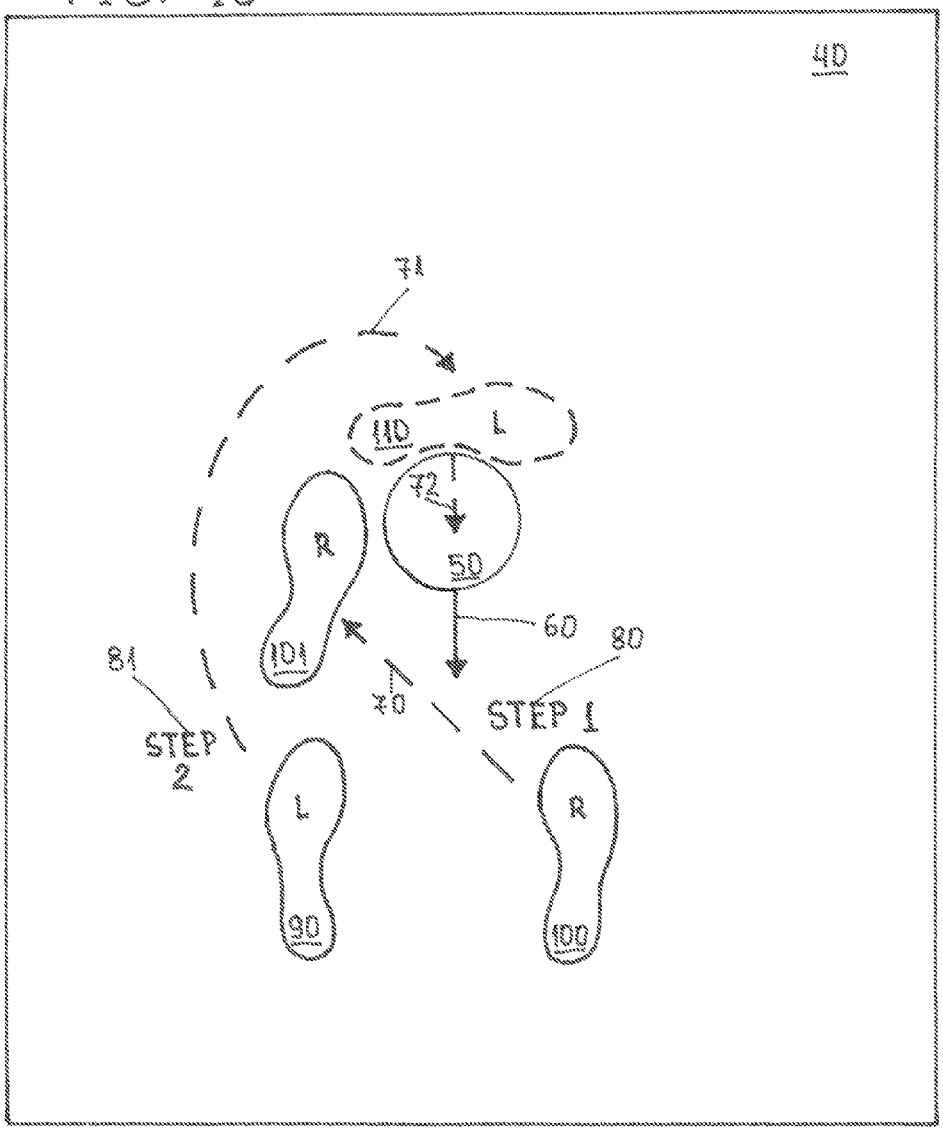

FIG. 10 demonstrates the soccer technique "Inside of foot cut back turn" using the left foot to control the soccer ball shown by left footstep indicator printed in dashed line 110.

Figure 11:
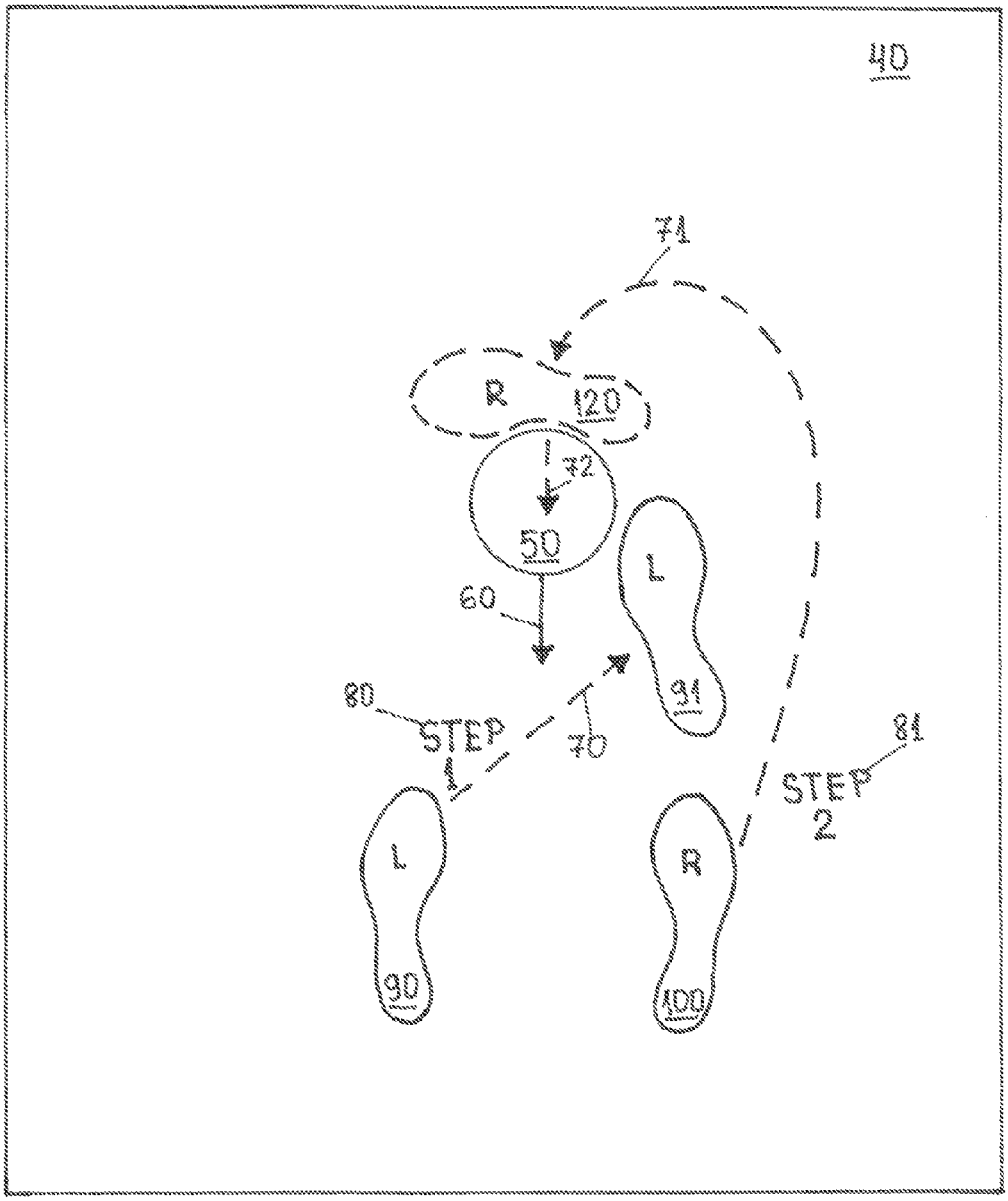

FIG. 11 demonstrates the soccer technique "Inside of foot cut back turn" this time using the right foot to control the soccer ball shown by right footstep indicator printed in dashed line 120.

Figure 12:
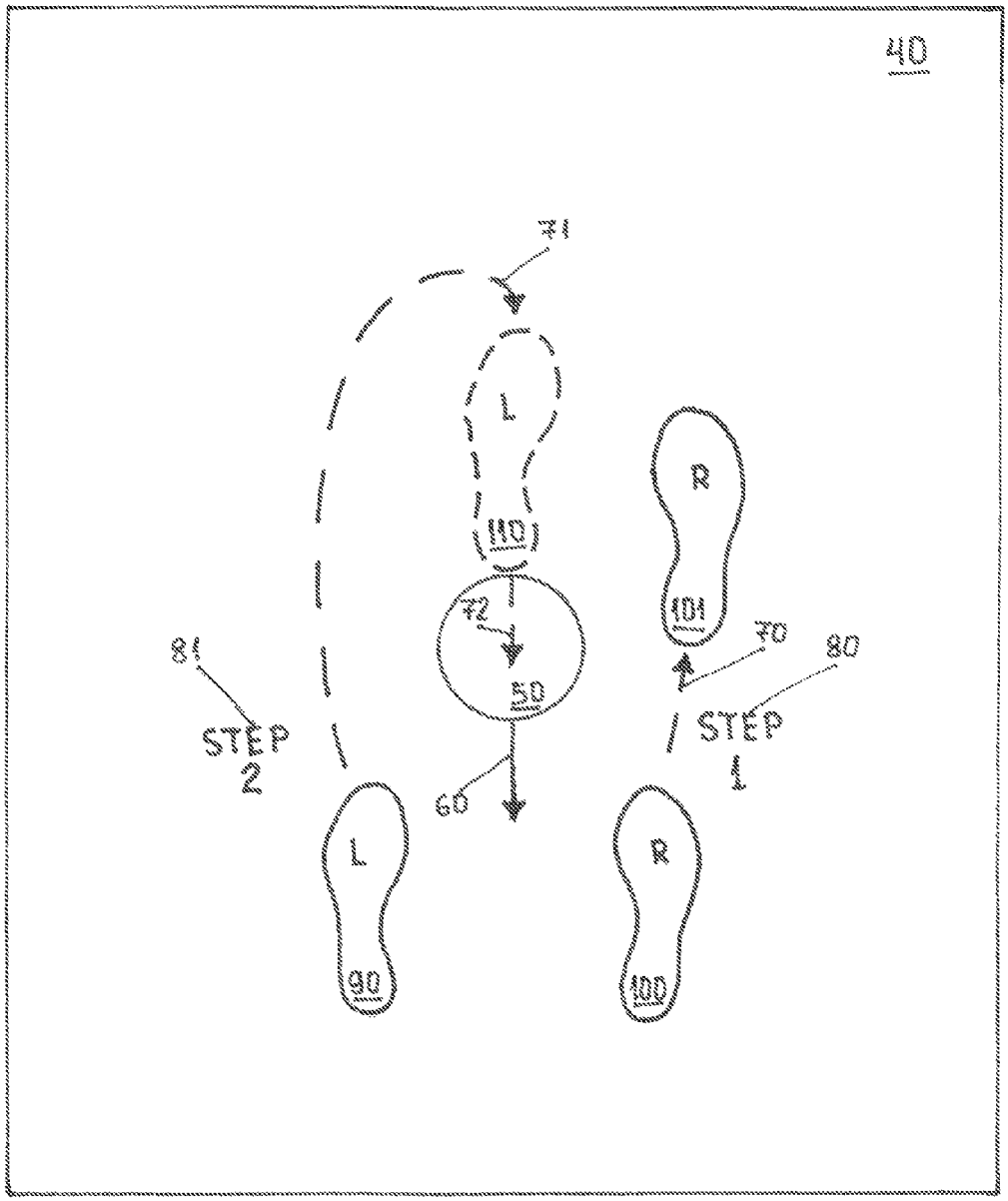

FIG. 12 demonstrates the soccer technique "Back heel turn" using the left foot to control the soccer ball shown by left footstep indicator printed in dashed line 110.

Figure 13:
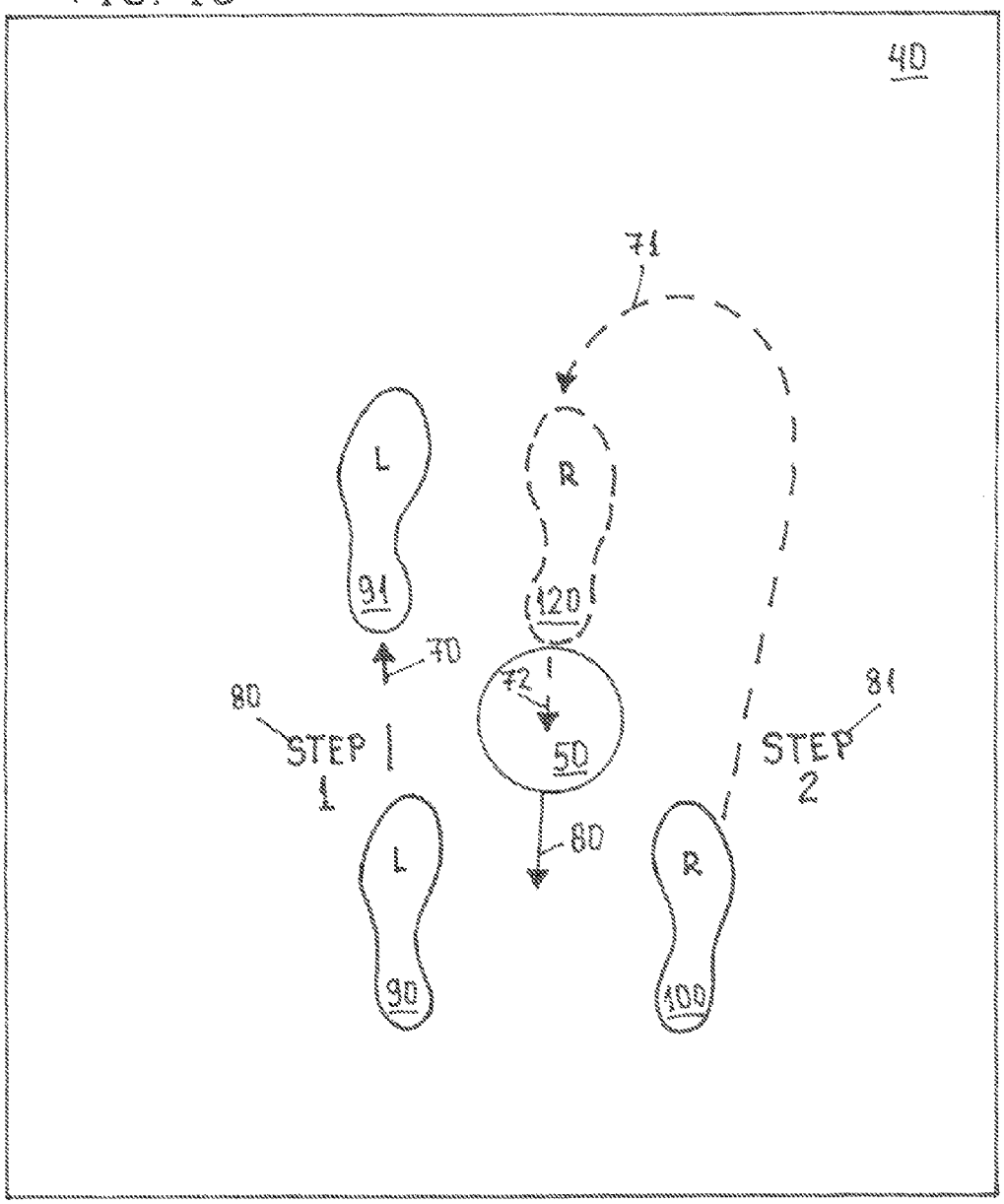

FIG. 13 demonstrates the soccer technique "Back heel: turn" using the right foot to control the soccer ball shown by right footstep indicator printed in dashed line 120.

Figure 14:
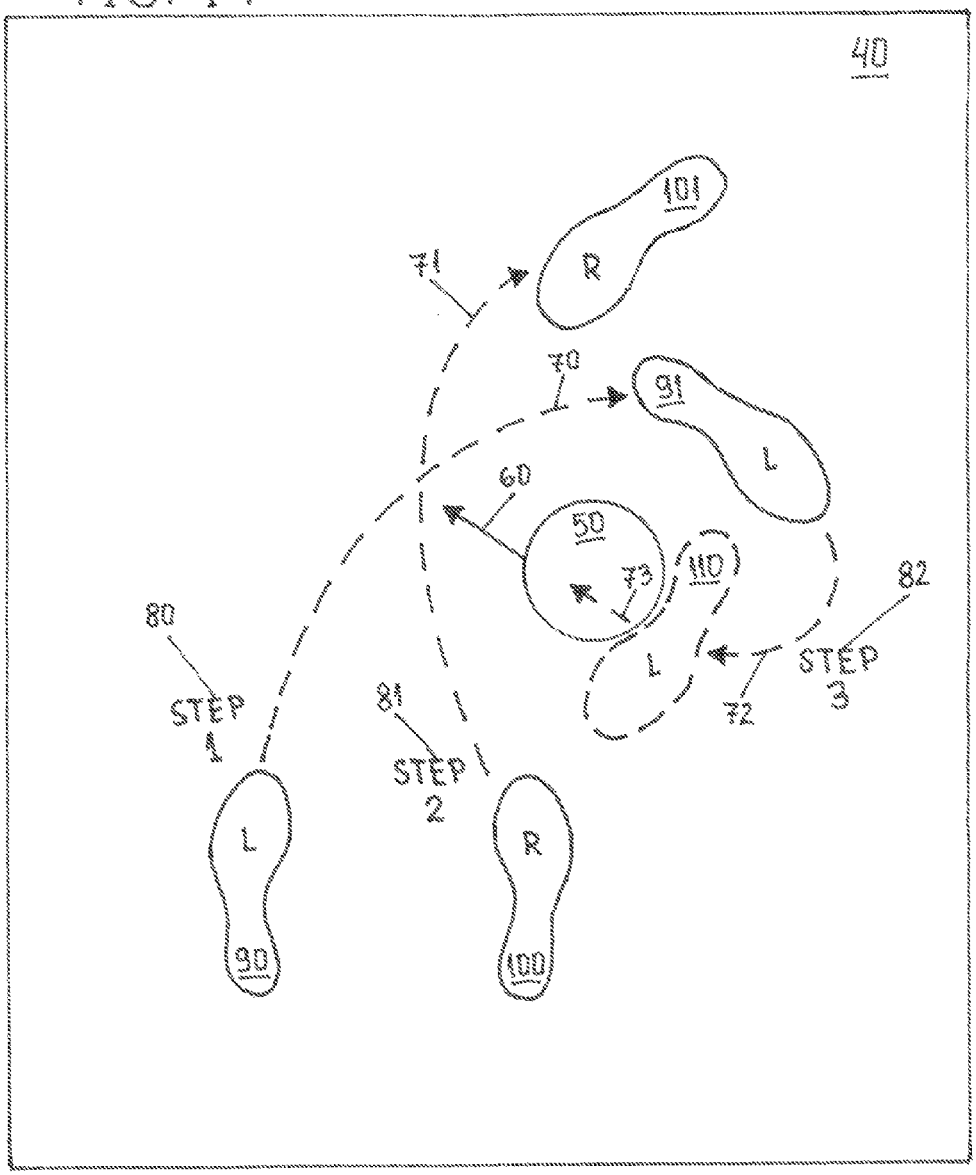

FIG. 14 demonstrates the soccer technique "Spin around turn" using the left foot to control the soccer ball shown by left footstep indicator printed in dashed line 110.

Figure 15:
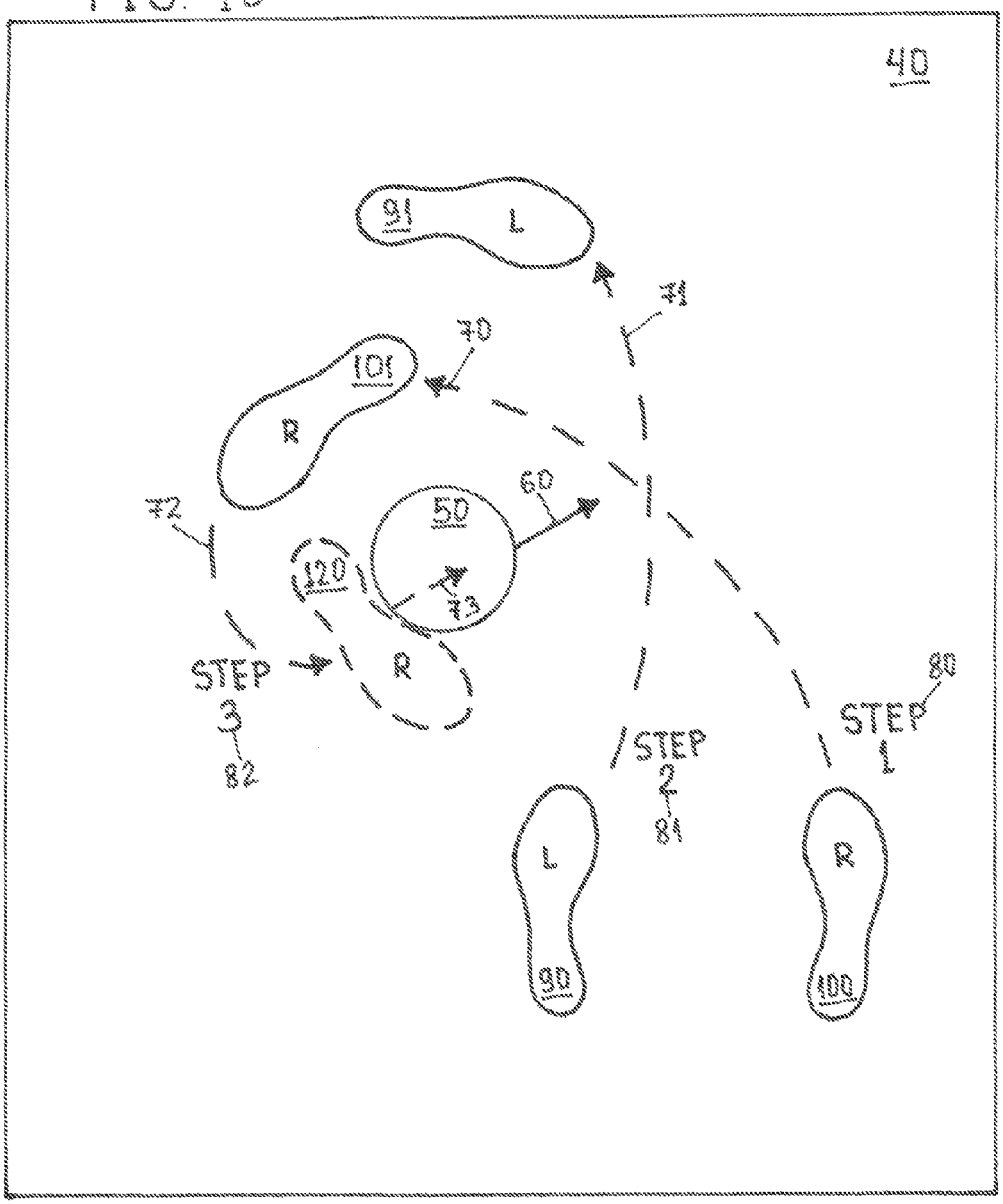

FIG. 15 demonstrates the soccer technique "Spin around turn" using the right foot to control the soccer bah shown by right footstep indicator printed in dashed line 120.

Figure 16:
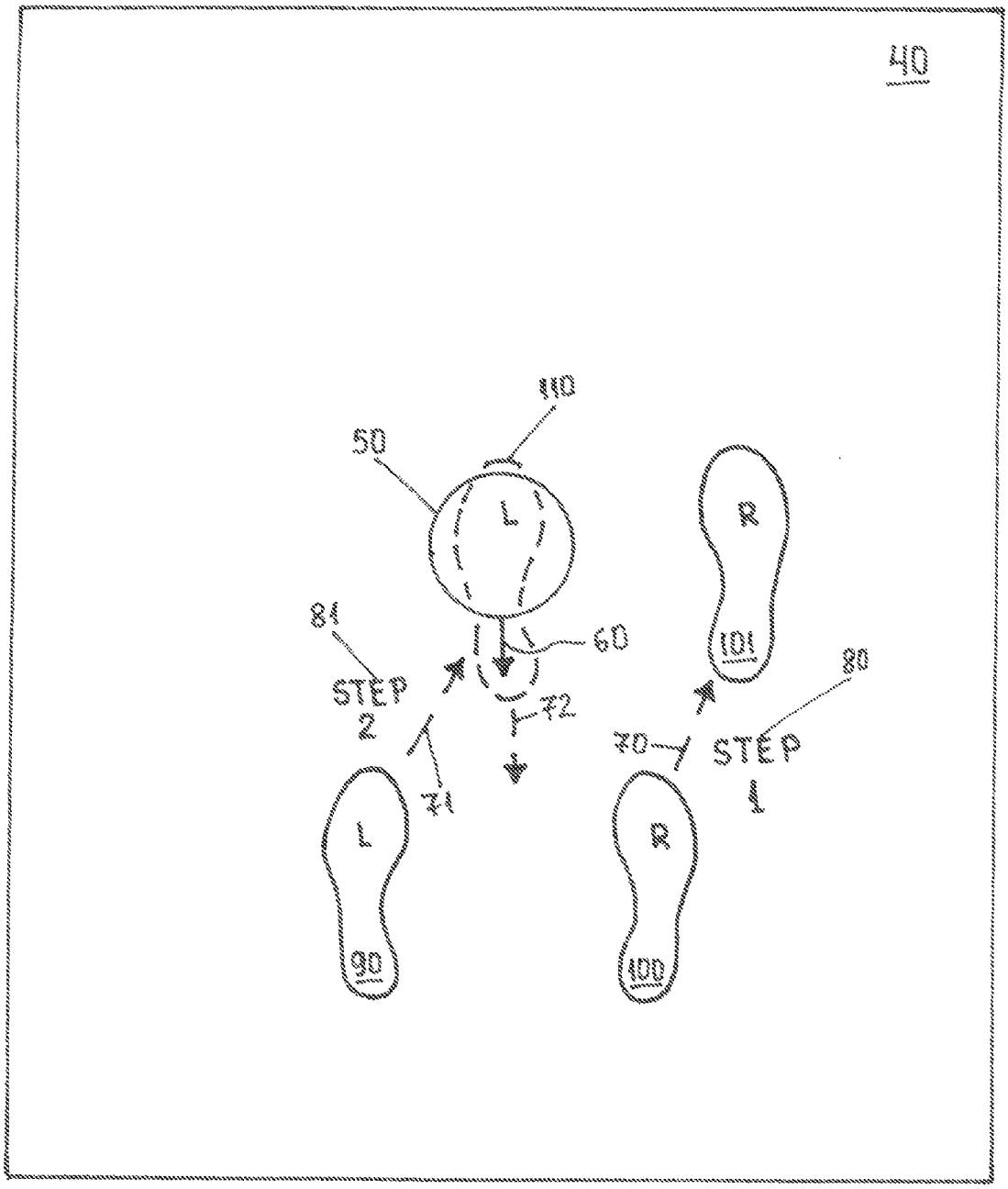

FIG. 16 demonstrates the soccer technique "Roll back turn" using the left foot to control the soccer ball shown by left footstep indicator printed in dashed line 110.

Figure 17:
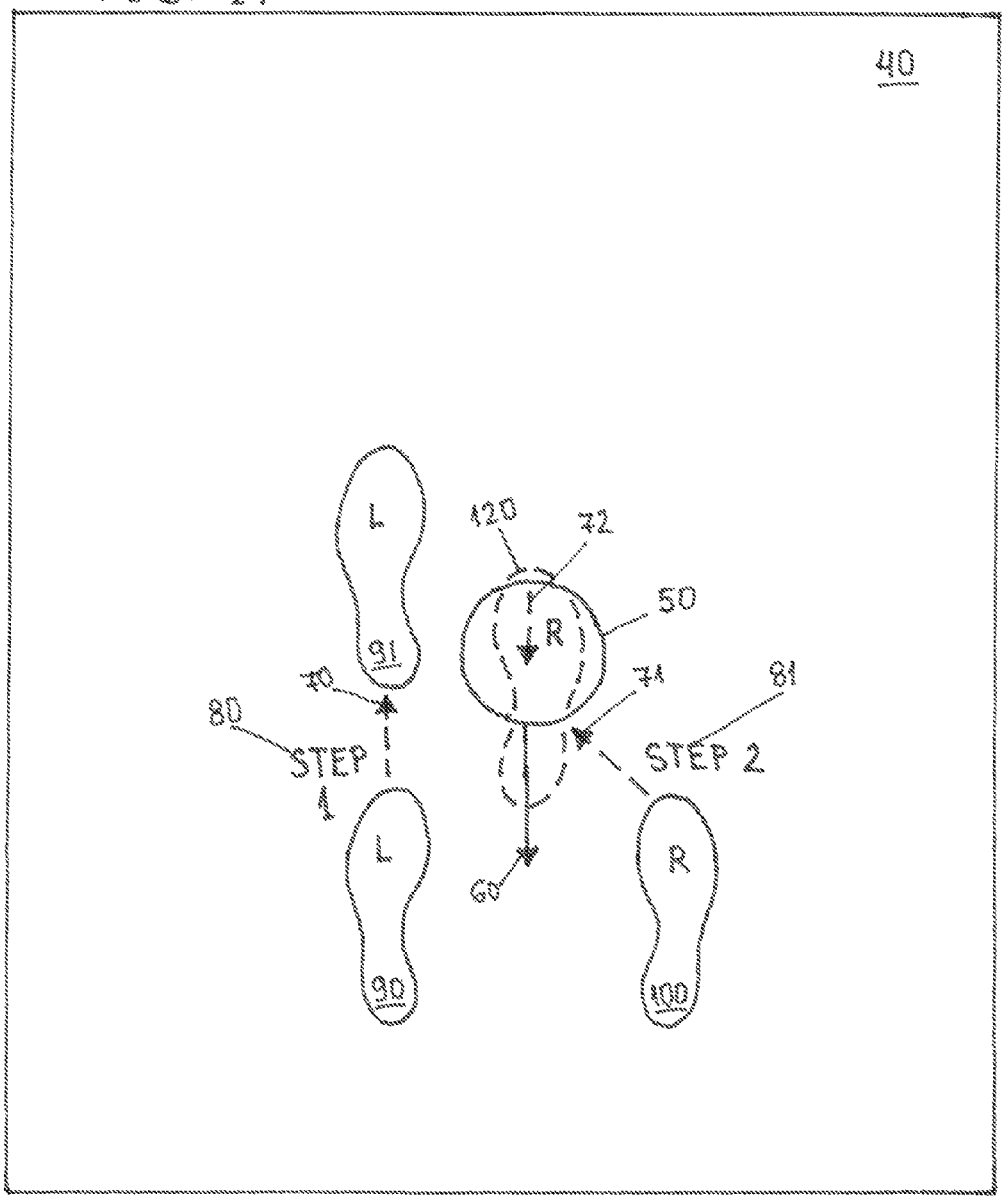

FIG. 17 demonstrates the soccer technique "Roll back turn" using the right foot to control the soccer ball shown by right footstep indicator printed in dashed line 120.

Figure 18:
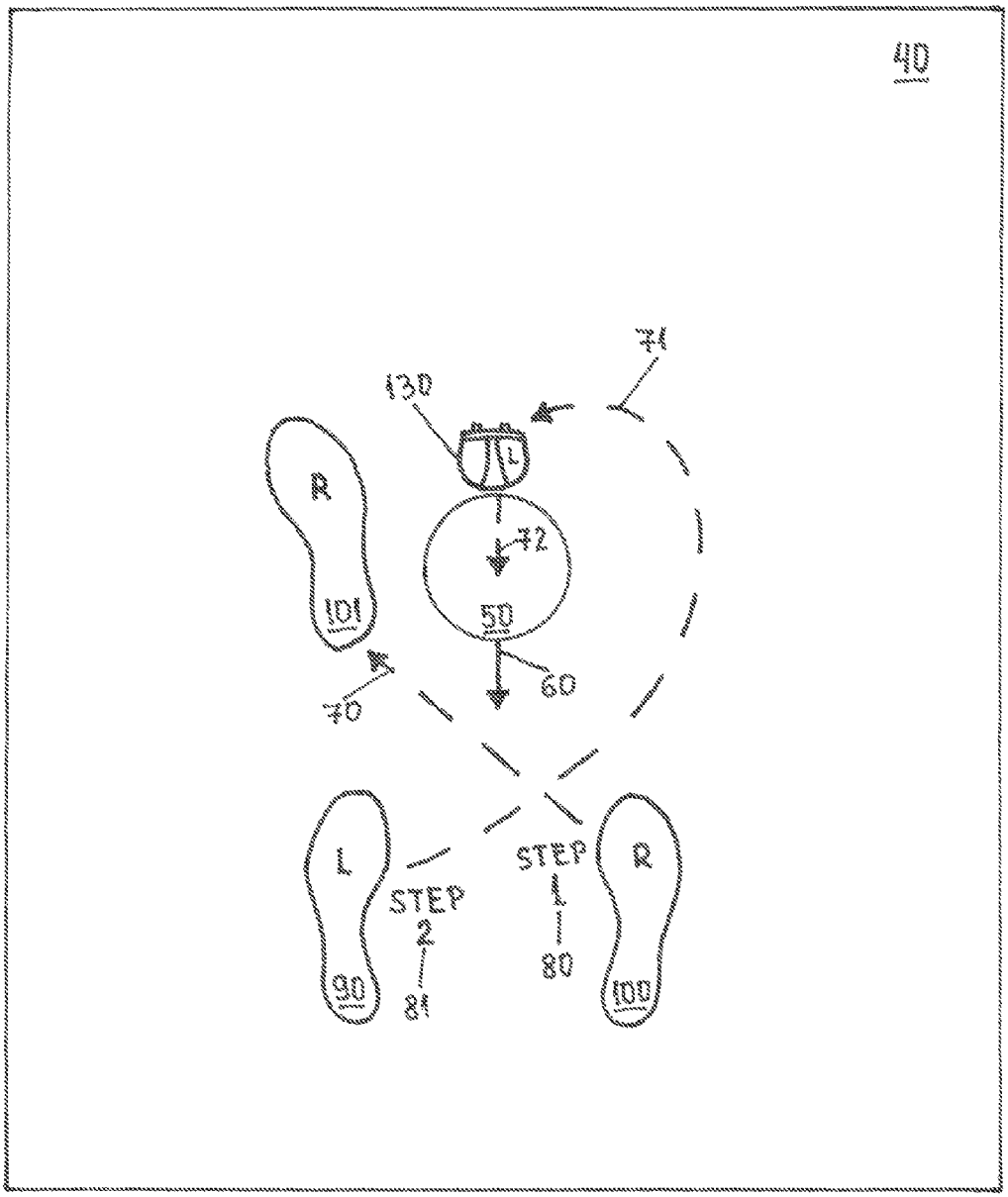

FIG. 18 demonstrates the soccer technique "Rabona turn" using the left foot to control the soccer ball shown by left footstep indicator printed in dashed line 130.

Figure 19:
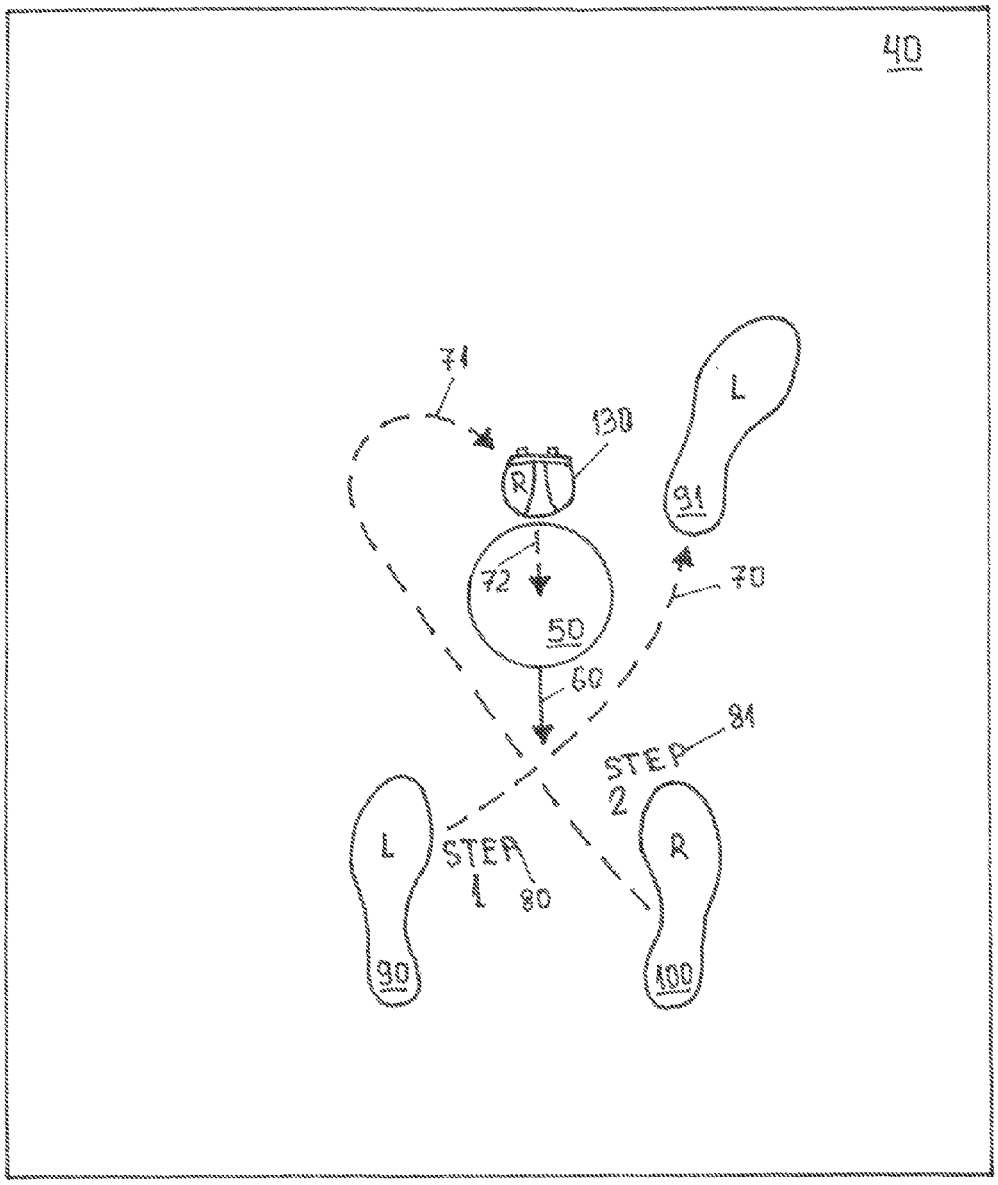

FIG. 19 demonstrates the soccer technique "Rabona turn" using the right foot to control the soccer ball indicated by shown by right footstep indicator printed in dashed line 130.

Figure 20:
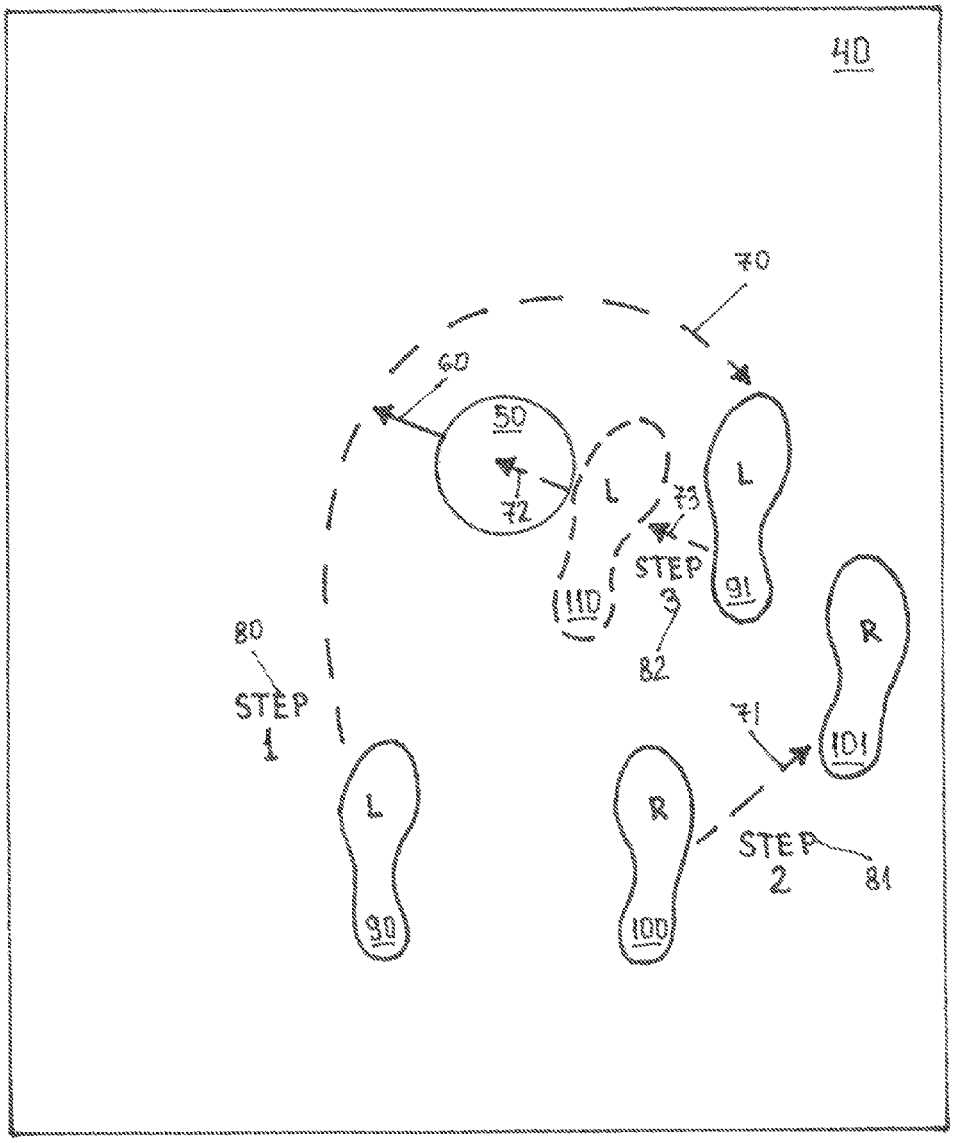

FIG. 20 demonstrates the soccer technique "Step over fake" using the left foot to control the soccer ball shown by left footstep indicator printed in dashed line 110.

Figure 21:
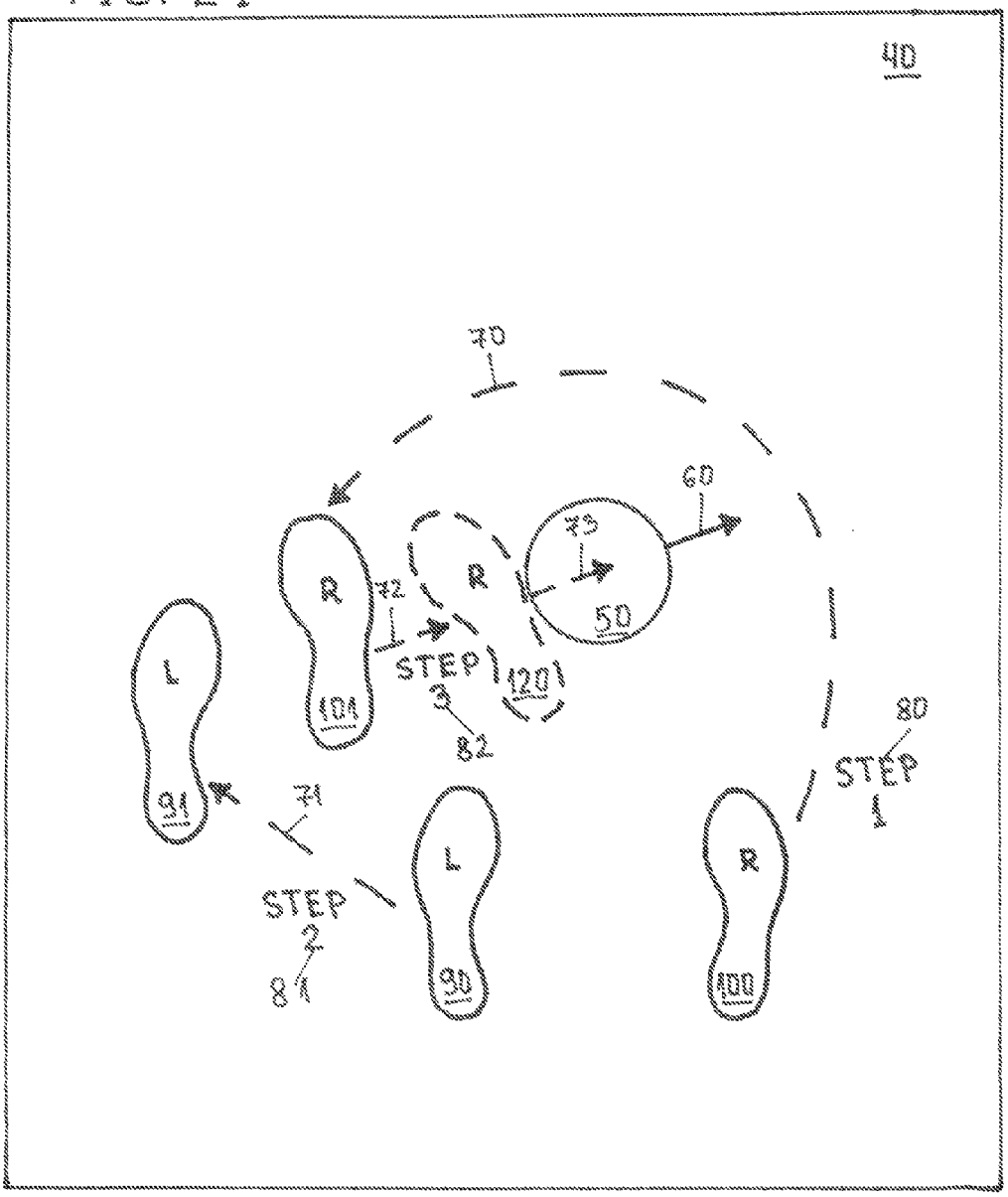

FIG. 21 demonstrates the soccer technique "Step over fake" using the right foot to control the soccer ball shown by right footstep indicator printed in dashed tine 120.

Figure 22:
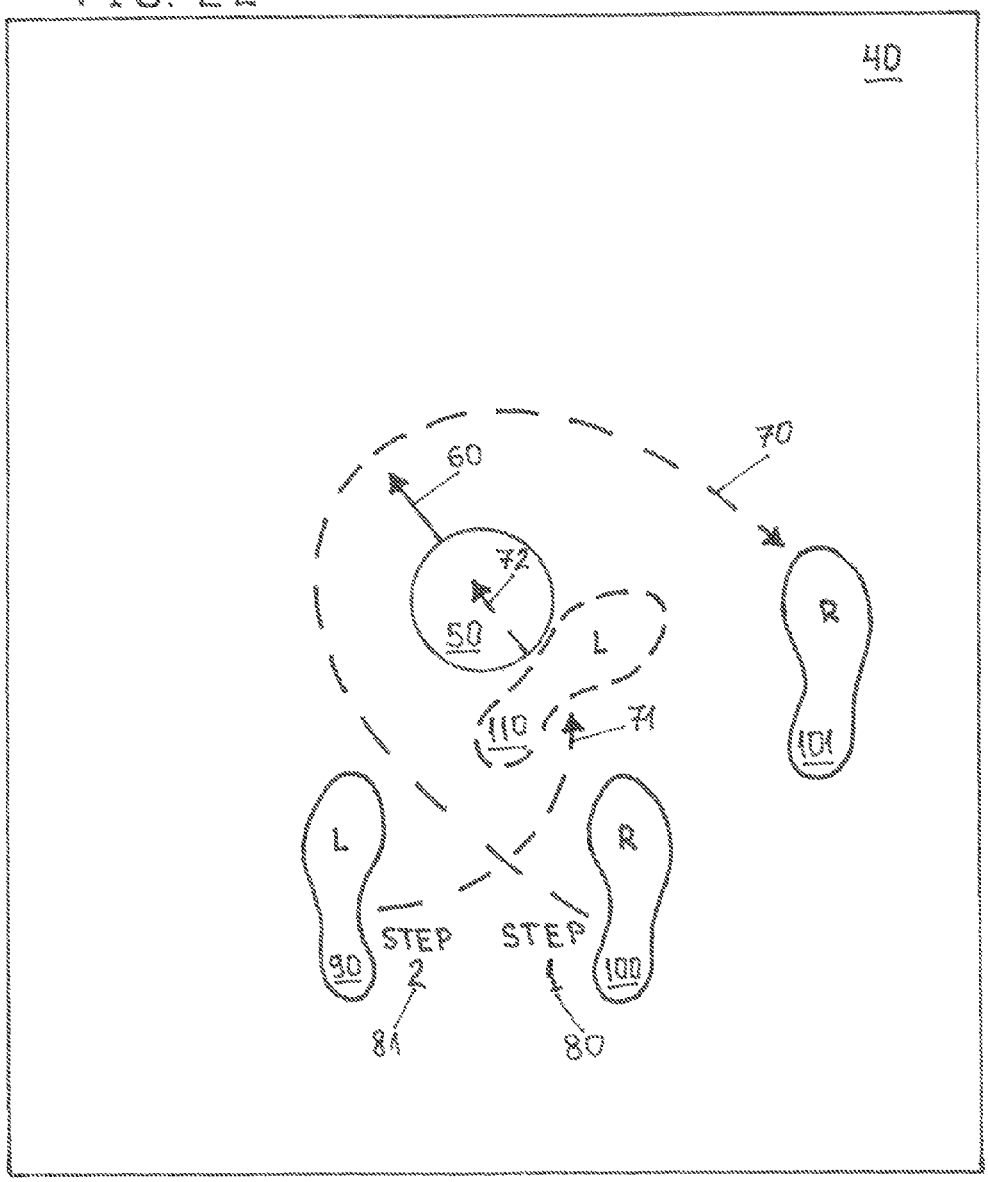

FIG. 22 demonstrates the soccer technique "Single Scissor fake" using the left foot to control the soccer ball shown by left footstep indicator printed in dashed line 110.

Figure 23:
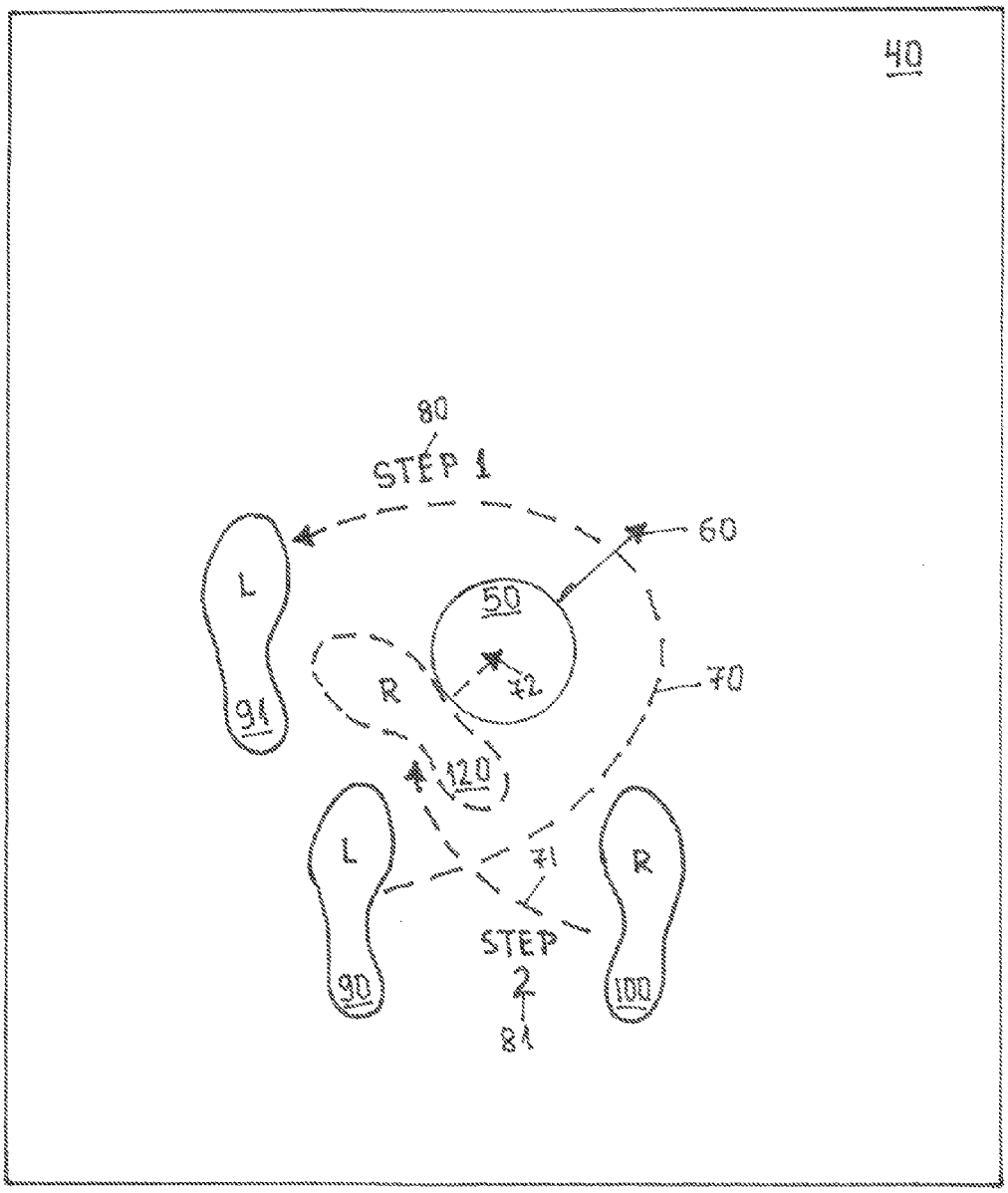
Figure 24:
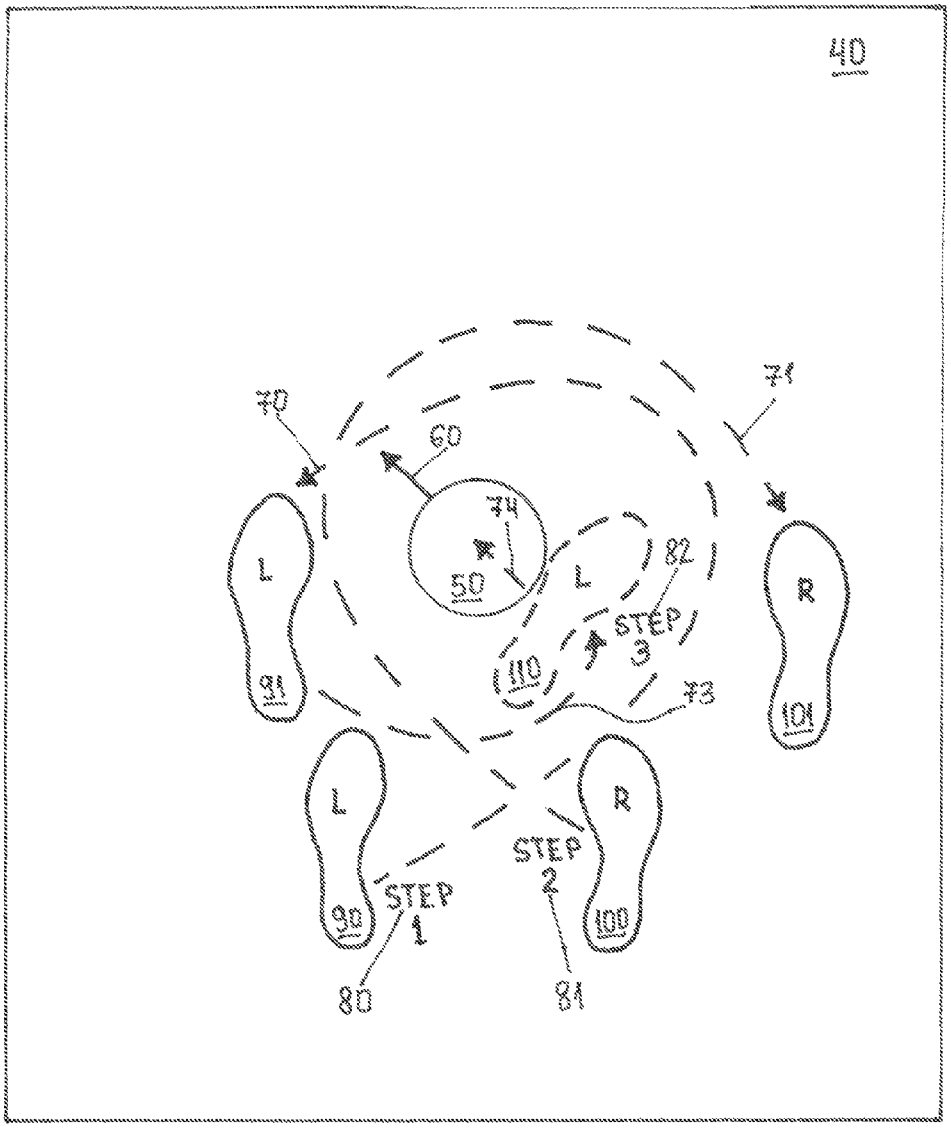

FIG. 23 demonstrates the soccer technique "Single Scissor fake" using the right foot to control the soccer ball shown by right footstep indicator printed in dashed line 120, FIG. 24 represent the soccer technique "Double Scissor fake" using the left foot to control the soccer ball shown by left footstep indicator printed in dashed line 110.

Figure 25:
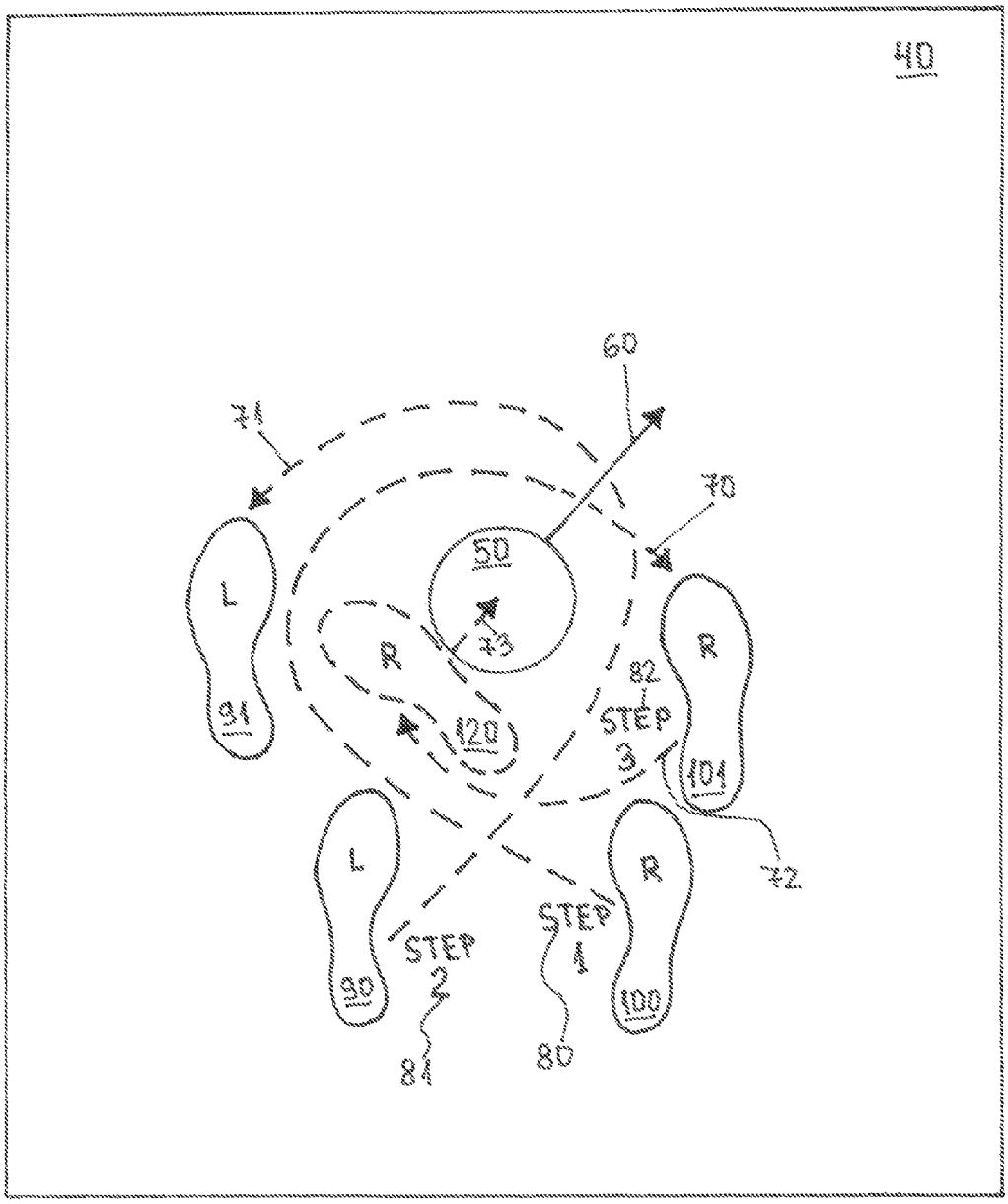

FIG. 25 demonstrates the soccer technique "Double Scissor fake" using the right foot to control the soccer ball shown by right footstep indicator printed in dashed line 120.

Figure 26:
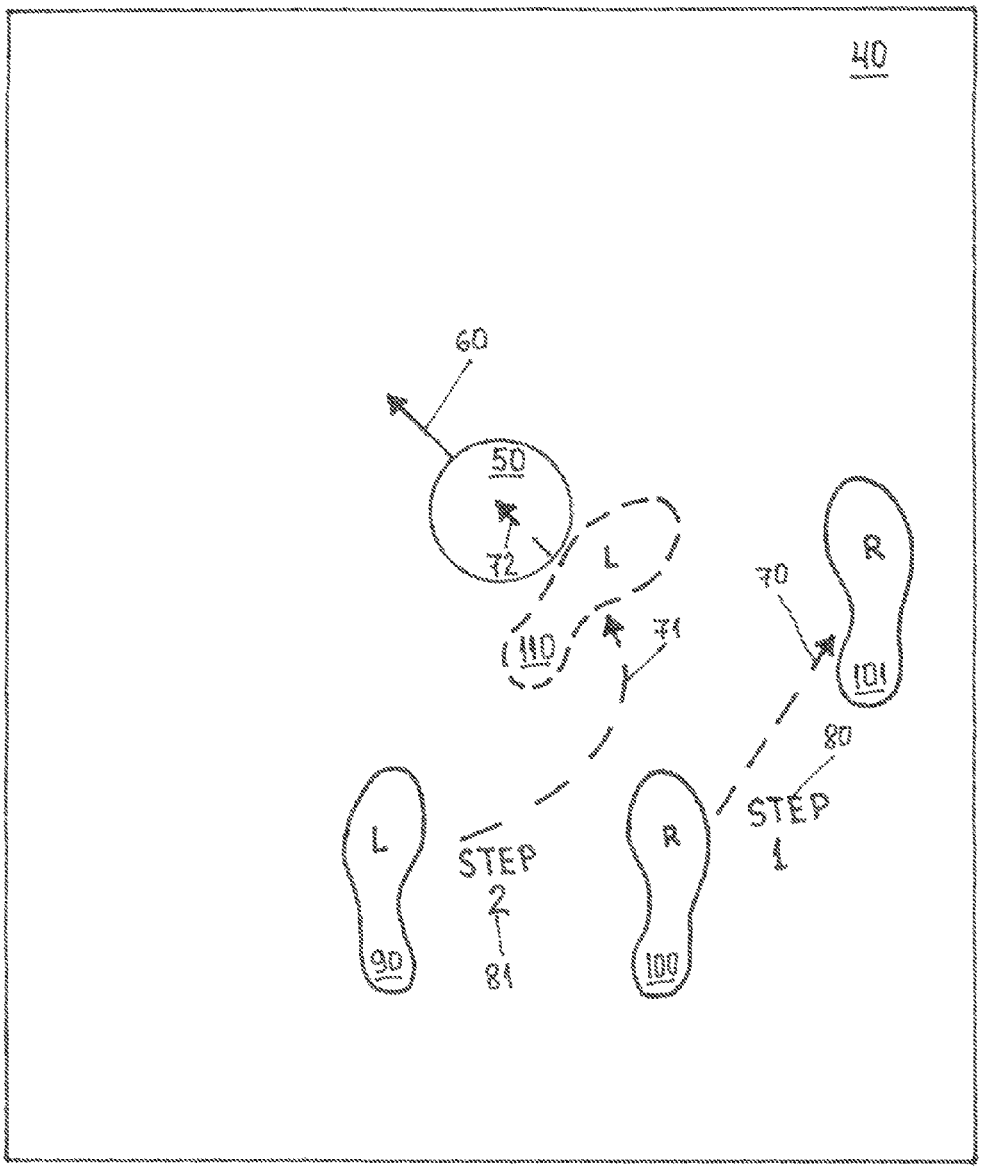

FIG. 26 demonstrates the soccer technique "Simple fake" using the left foot to control the soccer bail shown by left footstep indicator printed in dashed line 110.

Figure 27:
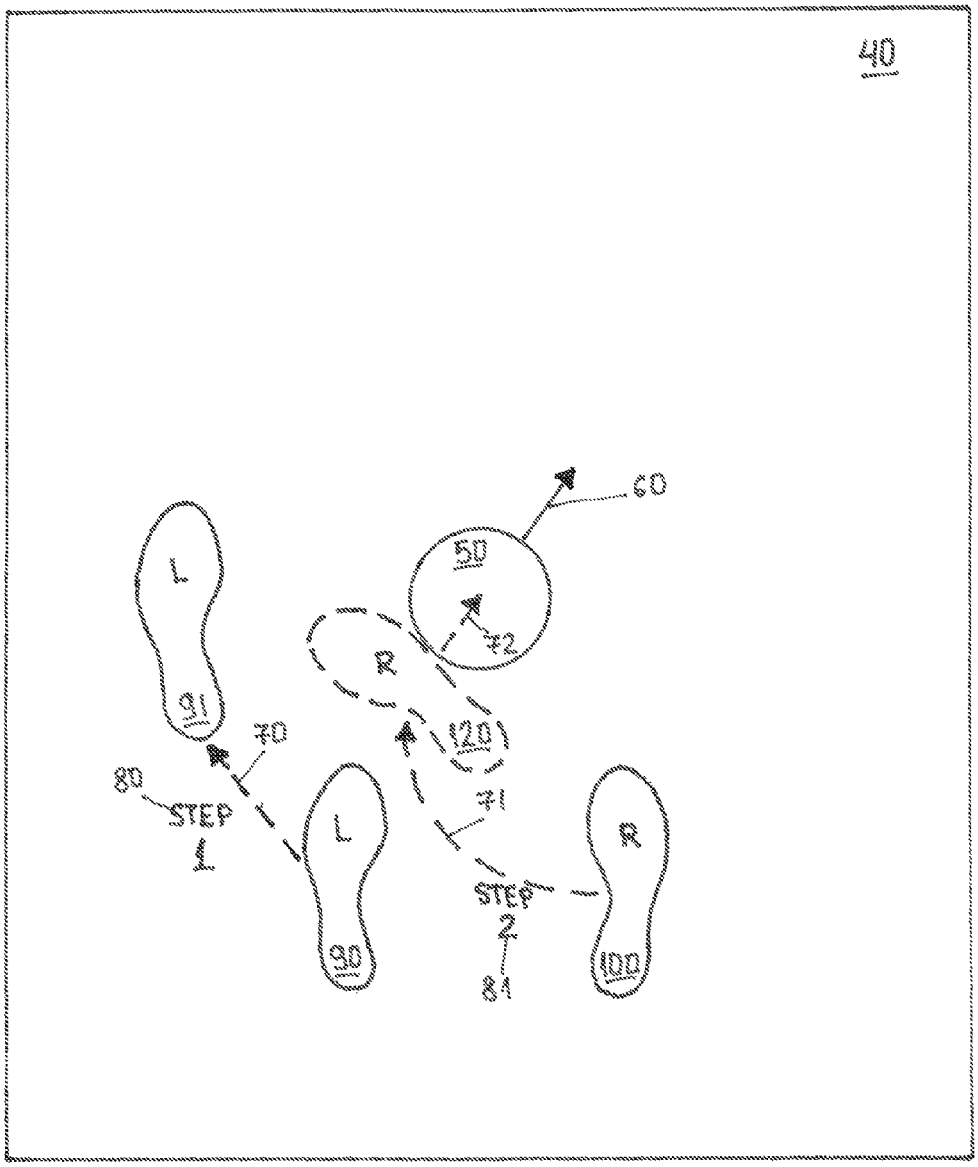

FIG. 27 demonstrates the soccer technique "Simple fake" using the right foot to control the soccer ball shown by right footstep indicator printed in dashed line 120.

Figure 28:
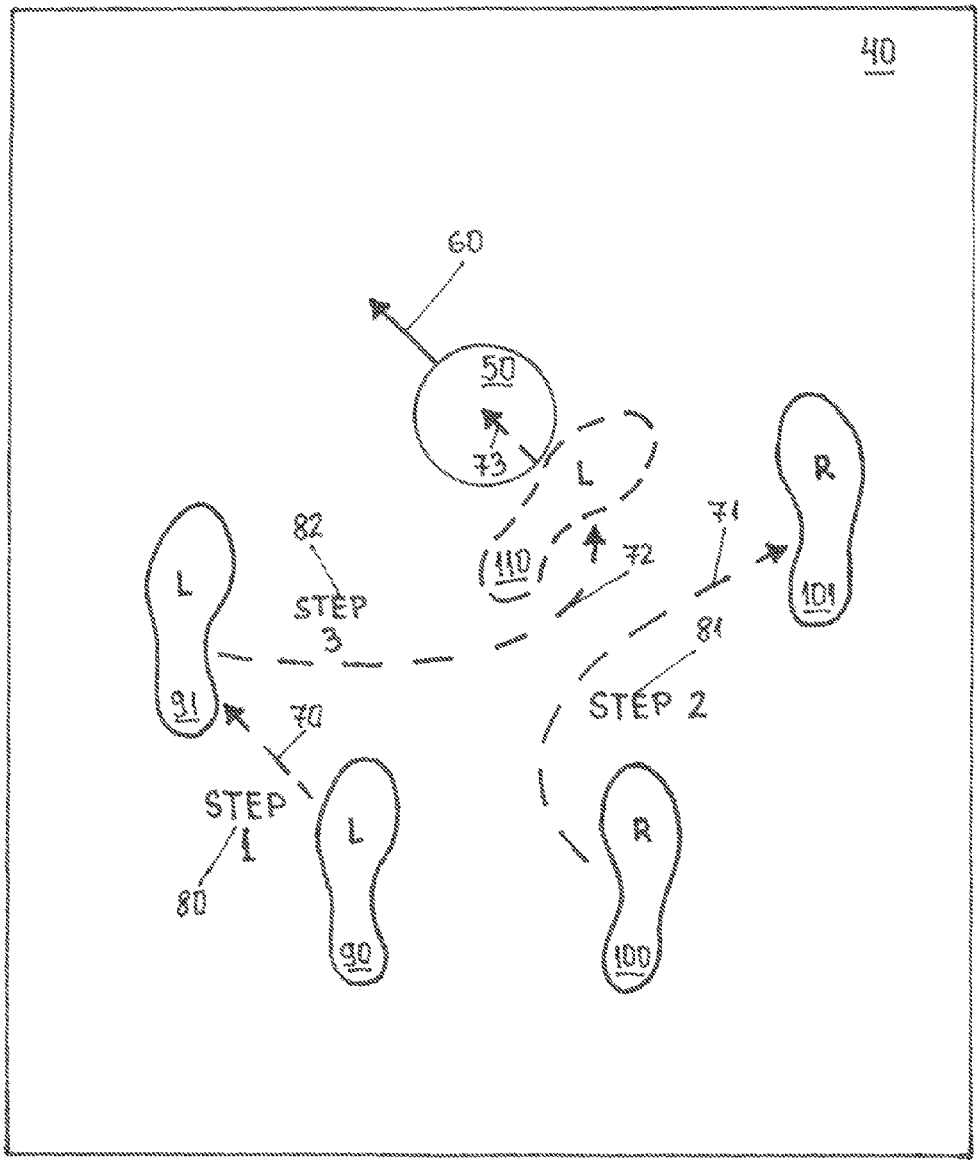

FIG. 28 demonstrates the soccer technique "Double Simple fake" using the left foot to control the soccer ball shown by left footstep indicator printed in dashed line 110.

Figure 29:
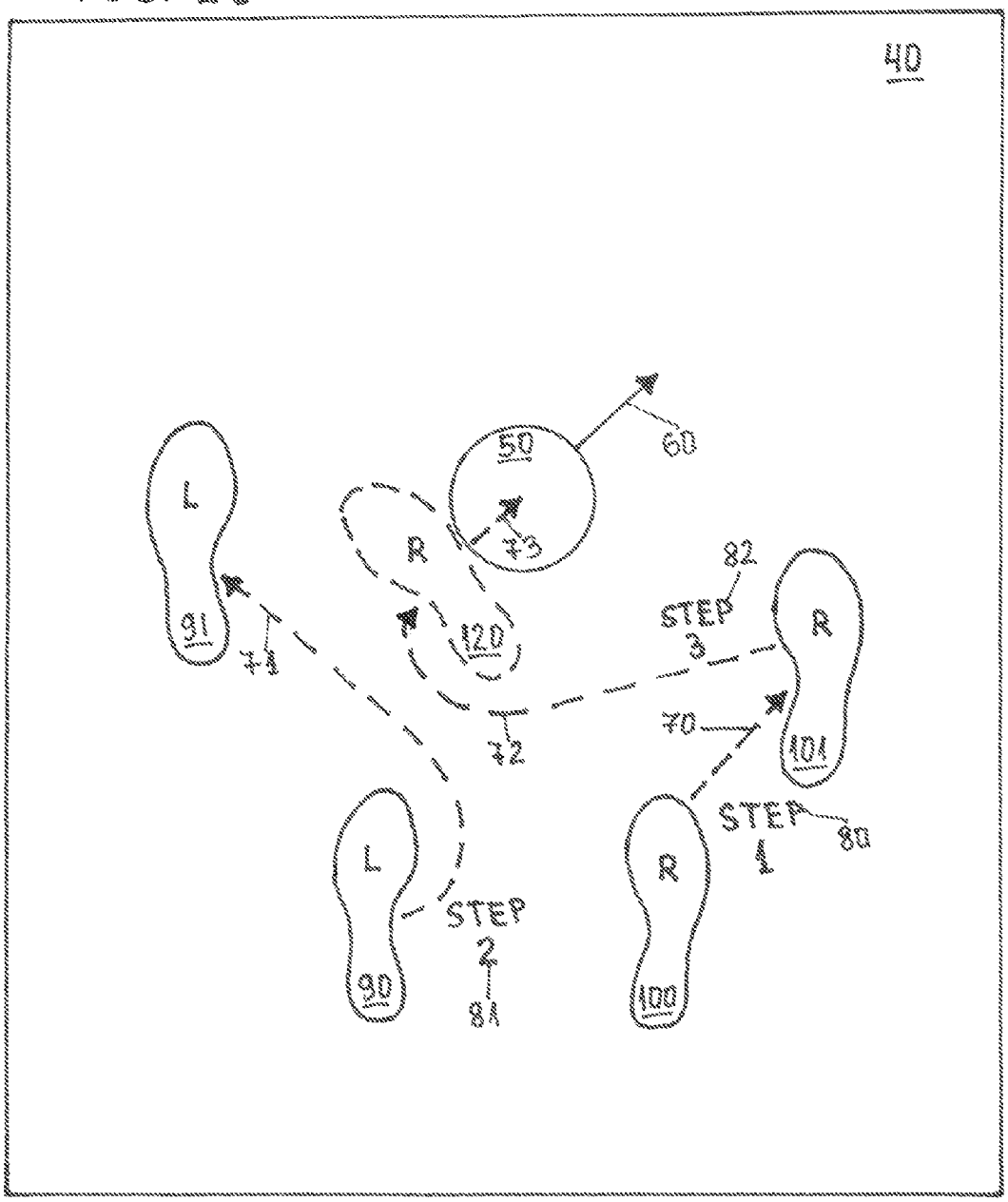

FIG. 29 represent the soccer technique "Double Simple fake" using the right foot to control the soccer ball shown by right footstep indicator printed in dashed line 120.

Figure 30:
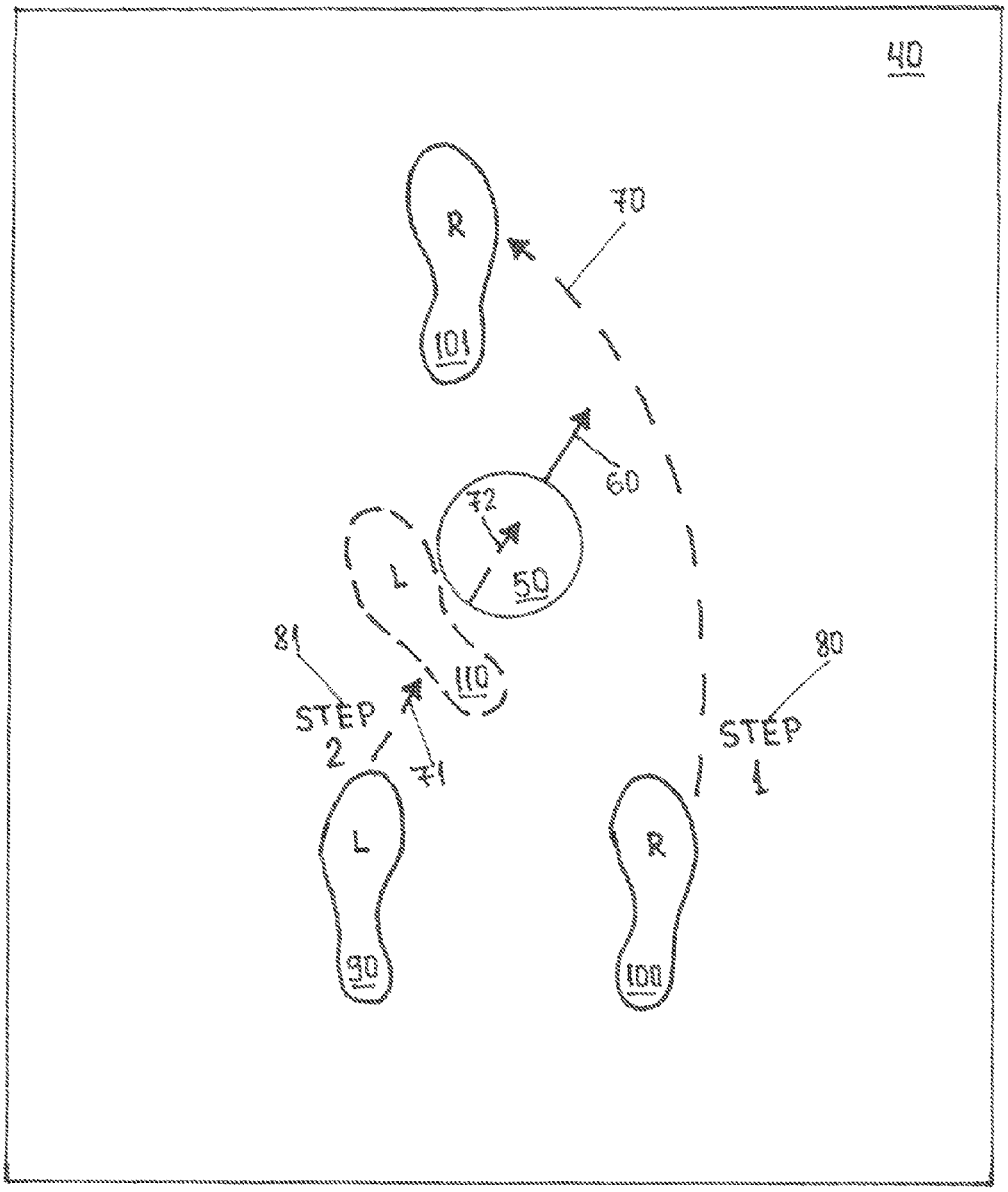

FIG. 30 demonstrates the soccer technique "Behind the foot flick" using the left foot to control the soccer bail shown by left footstep indicator printed in dashed line 110.

Figure 31:
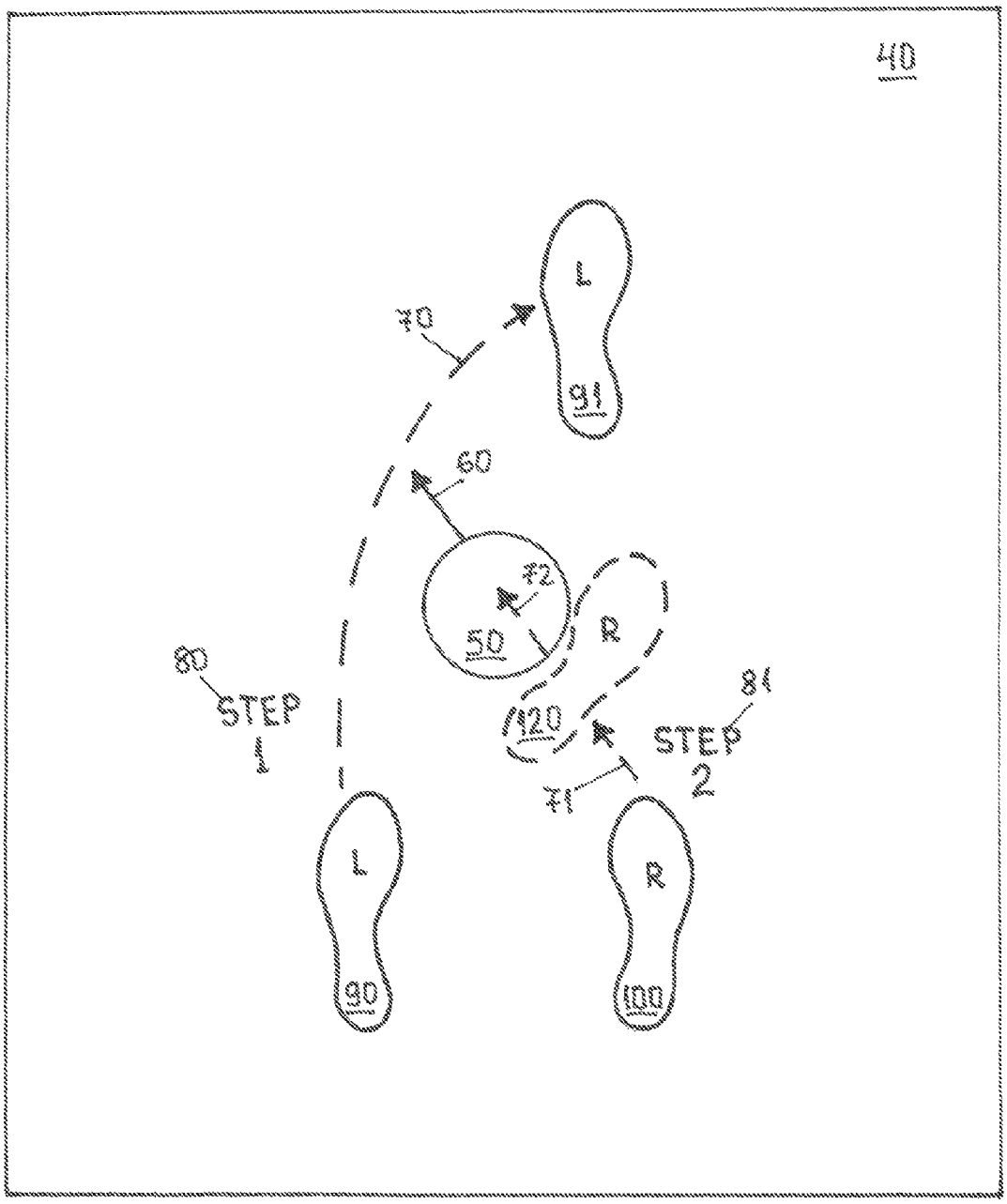

FIG. 31 demonstrates the soccer technique "Behind the foot flick" using the right foot to control the soccer ball shown by right footstep indicator printed in dashed line 120.

Figure 32:
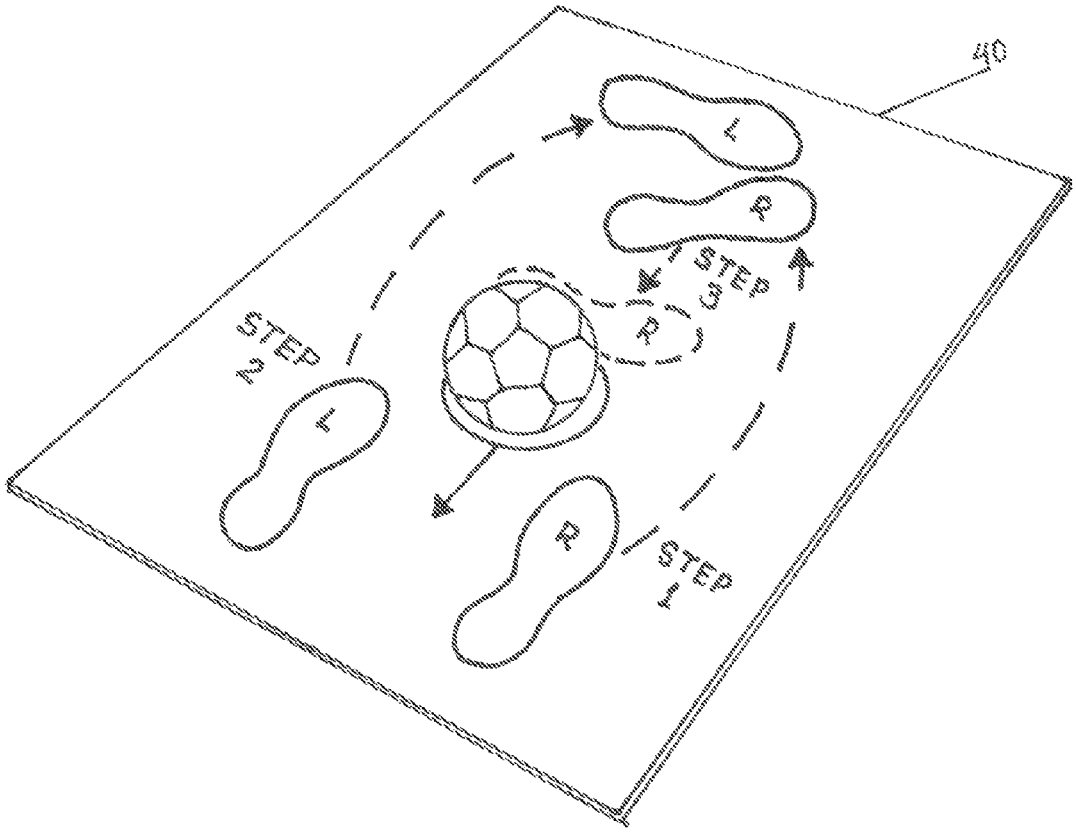
FIG. 32 is a top side view of the invention with the soccer ball placed on the appropriate location.

FIG. 32 shows the present invention with a soccer ball placed on top of the mat at the designated place.

I claim:

1. A set of soccer skill training mats for instructing a user proper foot placement and ball handling techniques, the set of mats comprising:

a plurality of mats, each mat having an upper surface and a lower surface;

the upper surfaces including a set of instructional indicia for aiding a user to carry out a sequence of soccer techniques;

wherein each of the upper surfaces include a different instructional indicia; and wherein the instructional indicia are identified by using:

a plurality of left and right foot indicators identified with a first set of indicia, the first set of indicia identifying proper foot placement on the upper surface of each mat;

a plurality of left and right foot indicators identified with a second set of indicia, the second set of indicia identifying proper foot movement off of each mat and over the upper surface of each mat;

at least one circular indicator identified with a third set of indicia for designating placement of a soccer ball;

at least one arrow identified with a fourth set of indicia for indicating the path of travel for a soccer ball after the soccer ball has been handled with at one of a right or left foot of a user;

a plurality of arrows identified with a fifth set of indicia for indicating a desired path and direction of movement of a user's right and left foot;

a sequence of numbered steps, identified by the first, second, fourth and fifth indicia; and further comprising written instructions for aiding a user to carry out the designated soccer techniques.

* * * * *